US006490430B1

(12) United States Patent
Chen et al.

(10) Patent No.: US 6,490,430 B1
(45) Date of Patent: Dec. 3, 2002

(54) EXTERNALLY HEATED ROLLER FOR A TONER FUSING STATION

(75) Inventors: Jiann-Hsing Chen, Fairport; Arun Chowdry, Rochester; James E. Mathers, Rochester; John W. May, Rochester; Borden H. Mills, Rochester; Alan R. Priebe, Rochester; Kenneth D. Stack, Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/680,138

(22) Filed: Oct. 4, 2000

(51) Int. Cl.[7] ..... G03G 15/20

(52) U.S. Cl. ..... 399/333; 219/216

(58) Field of Search ..... 399/258, 284, 399/274, 281, 272; 219/216

(56) References Cited

U.S. PATENT DOCUMENTS

| | | | | | |
|---|---|---|---|---|---|
| 3,854,975 | A | * | 12/1974 | Brenneman et al. | 430/98 |
| 3,863,603 | A | | 2/1975 | Beckley et al. | 118/637 |
| 3,959,574 | A | | 5/1976 | Seanor et al. | 428/425 |
| 3,983,287 | A | | 9/1976 | Goosen et al. | 428/241 |
| 4,023,967 | A | | 5/1977 | McGibbon | 96/1 LY |
| 4,255,508 | A | | 3/1981 | Kuehnle | 430/94 |
| 4,372,246 | A | * | 2/1983 | Azar et al. | 118/60 |
| 4,378,622 | A | | 4/1983 | Pinkston et al. | 29/148.4 D |
| 4,531,825 | A | | 7/1985 | Miwa et al. | 355/3 TR |
| 4,601,963 | A | | 7/1986 | Takahashi et al. | 430/69 |
| 4,791,275 | A | | 12/1988 | Lee et al. | 219/469 |
| 4,887,340 | A | * | 12/1989 | Kato et al. | 29/130 |
| 4,899,197 | A | | 2/1990 | Davis et al. | 355/290 |
| 5,014,406 | A | * | 5/1991 | Kato et al. | 29/130 |
| 5,038,178 | A | | 8/1991 | Hosoya et al. | 355/277 |
| 5,143,573 | A | | 9/1992 | Ammon et al. | 156/294 |
| 5,227,853 | A | | 7/1993 | Prouix et al. | 355/282 |
| 5,253,026 | A | * | 10/1993 | Tamary | 399/331 |
| 5,258,809 | A | | 11/1993 | Wiedemer | 355/200 |
| 5,298,956 | A | | 3/1994 | Mammino et al. | 355/275 |
| 5,335,054 | A | | 8/1994 | Lands et al. | 355/279 |
| 5,376,999 | A | | 12/1994 | Hwang | 355/326 R |
| 5,386,273 | A | | 1/1995 | Wood et al. | 355/212 |
| 5,415,961 | A | | 5/1995 | Yu et al. | 430/58 |
| 5,418,600 | A | | 5/1995 | Genovese | 355/200 |
| 5,438,398 | A | | 8/1995 | Tanigawa et al. | 355/271 |
| 5,481,349 | A | * | 1/1996 | Satoh et al. | 399/328 |
| 5,497,222 | A | | 3/1996 | Landa et al. | 355/279 |
| 5,508,789 | A | | 4/1996 | Castelli et al. | 355/208 |
| 5,519,475 | A | | 5/1996 | Miyamoto et al. | 355/271 |
| 5,553,541 | A | | 9/1996 | Vrotacoe et al. | 101/217 |
| 5,592,269 | A | | 1/1997 | Youses et al. | 399/237 |

(List continued on next page.)

FOREIGN PATENT DOCUMENTS

| | | | | |
|---|---|---|---|---|
| EP | 0 590 924 A1 | | 9/1993 | G03G/15/00 |
| EP | 0 928 999 A2 | | 1/1999 | G03G/13/09 |
| JP | 63-296081 A | * | 12/1988 | |
| JP | 3133695 | | 6/1991 | B41N/10/02 |
| JP | Hei 81996-114997 | | 5/1996 | G03G/15/16 |
| WO | WO 98/04961 | | 2/1998 | G03G/15/16 |

*Primary Examiner*—Quana M. Grainger
(74) *Attorney, Agent, or Firm*—James D. Leimbach

(57) ABSTRACT

A conformable roller for use in a fusing station of an electrostatographic machine, said fusing station being provided with a pressure roller for fusing a toner image on a receiver, said fuser roller made from a plurality of layers surrounding an axis of rotation, said conformable roller comprising a rigid cylindrically symmetric core member; a compliant base-cushion layer formed on the core member; a stiffening layer in intimate contact with and surrounding the base-cushion layer; a compliant release layer coated on the stiffening layer; and said fusing station including an external heat source for said fuser roller, at least one of said plurality of layers being thermally resistive.

24 Claims, 11 Drawing Sheets

U.S. PATENT DOCUMENTS

| | | | | |
|---|---|---|---|---|
| 5,636,349 | A | 6/1997 | Landa et al. | 399/307 |
| 5,669,045 | A | 9/1997 | Swain | 399/159 |
| 5,704,291 | A | 1/1998 | Lewis | 101/457 |
| 5,722,016 | A | 2/1998 | Godlove et al. | 399/159 |
| 5,745,829 | A | 4/1998 | Gazit et al. | 399/302 |
| 5,790,930 | A | 8/1998 | Fuschiwald | 399/302 |
| 5,894,796 | A | 4/1999 | Gelions | 101/219 |
| 5,946,525 | A | 8/1999 | Okamura et al. | 399/66 |
| 6,044,243 | A | 3/2000 | Hara | 399/302 |
| 6,075,965 | A | 6/2000 | Tombs et al. | 399/308 |

* cited by examiner

EXTERNALLY HEATED ROLLER FOR A TONER FUSING STATION

CROSS REFERENCE TO RELATED APPLICATIONS

Reference is made to the commonly assigned U.S. Patent Applications, the disclosures of which are incorporated herein by reference.

U.S. patent application Ser. No. 09/679,016 filed Oct. 4, 2000, in the names of Arun Chowdry et al, entitled DOUBLE-SLEEVED ELECTROSTATOGRAPHIC ROLLER AND METHOD OF USING.

U.S. patent application Ser. No. 09/679,113, filed Oct. 4, 2000, in the names of Robert Charlebois et al, entitled INTERMEDIATE TRANSFER MEMBER HAVING A STIFFENING LAYER AND METHOD OF USING.

U.S. patent application Ser. No. 09/679,177, filed Oct. 4, 2000, in the names of Muhammed Aslam et al, entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al, entitled EXTERNALLY HEATED DEFORMABLE FUSER ROLLER.

U.S. patent application Ser. No. 09/680,133, filed Oct. 4, 2000, in the names of Arun Chowdry et al, entitled SLEEVED PHOTOCONDUCTIVE MEMBER AND METHOD OF MAKING.

U.S. patent application Ser. No. 09/680,134, filed Oct. 4, 2000, in the names of Muhammed Aslam et al, entitled SLEEVED ROLLERS FOR USE IN A FUSING STATION EMPLOYING AN EXTERNALLY HEATED FUSER ROLLER.

U.S. patent application Ser. No. 09/680,135, filed Oct. 4, 2000, in the names of Jiann-Hsing Chen et al, entitled TONER FUSING STATION HAVING AN INTERNALLY HEATED FUSER ROLLER.

U.S. patent application Ser. No. 09/680,136 filed Oct. 4, 2000, in the names of Arun Chowdry et al, entitled IMPROVED INTERMEDIATE TRANSFER MEMBER.

U.S. patent application Ser. No. 09/680,139, filed Oct. 4, 2000, in the names of Robert Charlebois et al, entitled INTERMEDIATE TRANSFER MEMBER WITH A REPLACEABLE SLEEVE AND METHOD OF USING SAME.

FIELD OF THE INVENTION

This invention relates in general to electrostatographic imaging and, in particular, to fusing stations and rollers used therein. More particularly, this invention relates to fusing stations, useful for color imaging, wherein a stiffening layer is included in externally-heated compliant toner fuser rollers and compliant pressure rollers.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser member can be a roller, belt, or any surface having a suitable shape for fixing thermoplastic toner powder to the receiver. The fusing step in a roller fuser commonly consists of passing the toned receiver between a pair of engaged rollers that produce an area of pressure contact known as a fusing nip. In order to form such nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations comprising a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a Docutech 135 machine made by the Xerox Corporation. The other uses a compliant fuser roller to form the nip against a hard or relatively non-conformable comformable pressure roller, such as in a Digimaster 9110 machine made by Heidelberg Digital LLC. A fuser roller designated herein as compliant typically comprises a conformable layer having a thickness greater than about 2 mm and in some cases exceeding 25 mm. A fuser roller designated herein as hard comprises a rigid cylinder, which may have a relatively thin polymeric or conformable elastomeric coating, typically less than about 1.25 mm thick. A fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically comprise polymeric materials, made from elastomers.

The most common type of fuser roller is internally heated, i.e., a source of heat is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller which is internally heated near its surface is disclosed by Lee et al. in U.S. Pat. No. 4,791,275, which describes a fuser roller comprising two polyimide Kapton® sheets (sold by DuPont and Nemours) having a flexible ohmic heating element disposed between the sheets, the polyimide sheets surrounding a conformable polyimide foam layer attached to a core member. According to J. H. DuBois and F. W. John, Eds., in *Plastics,* 5th Edition, Van Nostrand and Rheinhold, 1974, polyimide at room temperature is fairly stiff with a Young's modulus of about 3.5 GPa–5.5 GPa (1 GPa=1 GigaPascal= $10^9$ Newton/$m^2$), but the Young's modulus of the polyimide sheets can be expected to be considerably lower at the stated high operational fusing temperature of the roller of at least 450°F.

An externally heated fuser roller is used, for example, in an Image Source 120 copier, marketed by Eastman Kodak Company, and is heated by surface contact between the fuser roller and one or more heating rollers. Externally heated fuser rollers are also disclosed by O'Leary, U.S. Pat. No. 5,450,183, and by Derimiggio et al., U.S. Pat. No. 4,984,027.

A compliant fuser roller may comprise a conformable layer of any useful material, such as for example a substantially incompressible elastomer, i.e., having a Poisson's ratio approaching 0.5. A substantially incompressible conformable layer comprising a poly(dimethyl siloxane) elastomer has been disclosed by Chen et al., in the commonly assigned U.S. patent application Ser. No. 08/879,896, which is hereby incorporated by reference. Alternatively, the conformable layer may comprise a relatively compressible foam having a value of Poisson's ratio much lower than 0.5. A conformable polyimide foam layer is disclosed by Lee in U.S. Pat. No. 4,791,275, and a lithographic printing blanket is disclosed by Goosen et al. in U.S. Pat. No. 3,983,287, comprising a conformable layer containing a vast number of frangible rigid-walled tiny bubbles which are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

When the fuser and pressure rollers of a simplex fusing station are pressed against each other, and the conformable layer is deflected to form the fusing nip, the thickness of the conformable layer is reduced inside the nip. When the conformable layer is substantially incompressible, the average speed of the conformable layer through the fusing nip must be greater than that of other parts of the conformable layer that are well away from the nip, because the volume flow rate of the elastomer is constant around the roller. This results in a surface speed of the conformable roller inside the nip, which is faster than far away from the nip. When, for example, the conformable roller is a driving roller frictionally rotating a relatively non-conformable pressure roller, the pressure roller will rotate faster than if the fuser roller had been non-compliant, a phenomenon known as "overdrive". Overdrive may be expressed quantitatively as a peripheral speed ratio, measured as the ratio of the peripheral surface speeds far away from the nip.

A substantially incompressible elastomer that is displaced in the fusing nip results in an extra thickness of the conformable layer adjacent to either side of the fusing nip, i.e., pre-nip and post-nip bulges. Again, since the elastomer is substantially incompressible, the average speed of the conformable layer in these bulges is less than that of the other parts of the conformable layer that are well away from the nip. The highest pressure in the nip will be obtained at the center of the nip (at the intersection of the joined surfaces and an imaginary line between the centers of the two rollers). Since one roller drives the other, the surface velocities of the rollers should be close to equal at the point of maximum pressure, at the center of the nip. In view of these facts, it may be understood that in general there will be locations in the contact zone of the nip where the surface velocities of the two rollers differ, i.e., there will be slippage. This slippage, which may be substantial just after entry and just before exit of the nip, is a cause of wear which shortens roller life.

A potentially serious problem for fusing arising from the presence of overdrive is "differential overdrive", associated for example with tolerance errors in mounting the rollers forming the fusing nip, or with roller runout. Runout can have many causes, e.g., fluctuations in layer thicknesses along the length of a roller, variations in the dimensions of a core member, an acentric roller axis, and so forth. It will be evident that differential overdrive can result in localized differential slippages along the length of a fusing nip, inasmuch as the local effective speed ratio would otherwise tend to fluctuate or change with time along the length of the nip, causing some portions of the driven roller to try to lag and other portions to try to move faster than the average driven speed. Differential overdrive can have serious consequences for fusing, including the formation of large-scale image defects and wrinkling of a receiver.

All rollers suffer from surface wear, especially where the edges of receivers contact the rollers. Since relative motion due to slippage between rollers increases wear, the changes in velocity of the surface of a conformable roller, as it travels into, through, and out of a fusing nip formed with a relatively non-conformable roller, should increase the wear rate of the conformable roller, especially if the conformable roller is the heated fusing member, bearing in mind that a fuser roller typically faces a relatively rough and abrasive paper surface in the nip. Moreover, since the material on the conformable roller is stretched and relaxed each time it passes through the fusing nip, this flexure can result in fatigue aging and wear, including failure of the roller due to splitting or cracking of the compliant material, or even delamination.

To obtain high quality electrophotographic copier/printer image quality, image defects must be reduced. One type of defect is produced by smearing of image dots or other small-scale image features in the fusing nip. Relative motions associated with overdrive and resulting in localized slippage between rollers in a fusing nip can cause softened toner particles to smear parallel to the direction of motion, resulting for example in elongated dots.

Some roller fusers rely on film splitting of low viscosity oil to enable release of the toner and (hence) receiver from the fuser roller. Relative motion in the fusing nip can disadvantageously disrupt the oil film.

A toner fuser roller commonly includes a hollow cylindrical core, often metallic. A resilient base-cushion layer, which may contain filler particles to improve mechanical strength and/or thermal conductivity, is formed on the surface of the core, which may advantageously be coated with a primer to improve adhesion of the resilient layer. Roller cushion layers are commonly made of silicone rubbers or silicone polymers such as, for example, poly (dimethylsiloxane) (PDMS) polymers of low surface energy, which minimize adherence of toner to the roller.

Frequently, release oils composed of, for example, poly (dimethylsiloxanes) are also applied to the fuser roller surface to prevent the toner from adhering to the roller. Such release oils (commonly referred to as fuser oils) may interact with the PDMS in the resilient layer upon repeated use, which in time causes swelling, softening, and degradation of the roller. To prevent these deleterious effects caused by release oil, a thin barrier layer of, for example, a cured polyfluorocarbon, is formed on the cushion layer.

Electrophotography can be used to create high quality multicolor toner images when the toner particles are small, that is, diameters less than about 10 micrometers, and the receivers, typically papers, are smooth. A typical method of making a multicolor toner image involves trichromatic color synthesis by subtractive color formation. In such synthesis, successive imagewise electrostatic images, each representing a different color, are formed on a photoconductive element, and each image is developed with a toner of a different color. Typically, the colors correspond to each of the three subtractive primary colors (cyan, magenta and yellow) and, optionally, black. The imagewise electrostatic images for each of the colors can be made successively on the photoconductive element by using filters to produce color separations corresponding to the colors in the image. Following development of the color separations, each developed separation image can be transferred from the photoconductive element successively in registration with the other color toner images to an intermediate transfer member. All the color toner images can then be transferred in one step from the intermediate transfer member to a receiver, where they are fixed or fused to produce a multicolor permanent image. Alternatively, an electrophotographic apparatus comprising a series of tandem modules may be employed, such as disclosed by Herrick et al., in U.S. Pat. No. 6,016,415, wherein color separation images are formed in each of four color modules and transferred in register to a receiver member as the receiver member is moved through the apparatus while supported on a transport web.

To rival the photographic quality produced using silver halide technology, it is desirable that these multicolor toner images have high gloss. To this end, it is desirable to provide a very smooth fusing member contacting the toner particles in the fusing station.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient cushion layer. The extent of the contact area helps establish the length of time that any given portion of the toner image will be in contact with and heated by the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

A well-known problem in fusing is that paper receiver sheets may not be perfectly rectangular, as a result of humidity-induced swelling. After manufacture, paper sheets are typically stacked and conditioned in a humidity-controlled environment. During this time, moisture partially penetrates the paper through the edges of the sheets. For typical commercial paper used in electrophotographic machines, moisture penetration is much faster in a direction parallel to the orientation of the long paper fibers. A typical 8.5"×11" paper sheet has long paper fibers oriented substantially parallel to the 11" direction, and moisture therefore penetrates preferentially into the 8.5" edges. This causes the nominally 8.5" edges to expand, so that the 8.5" edges become about 1% to 2% longer than the width of the paper measured across the center of the sheet (parallel to the 11" direction). It is usual practice to feed such paper sheets into a fuser nip with the 8.5" edges parallel to the feeding direction, i.e., perpendicular to the roller axes. Therefore, unless corrective measures are taken, it typically takes a longer time for the swollen 8.5" edges to pass through the fusing nip than it does for the middle of the sheet, which can result in severe paper wrinkling and large scale image defects. In order to provide a correction for this problem, it is known that elastomerically coated fusing station rollers may be manufactured with an axially varying profile obtained by gradually varying the thickness of the elastomeric coating, such that the outer diameter of a roller is greater near the ends of the roller than midway along the length of the roller. Inasmuch as elastomerically induced overdrive increases with increasing engagement, the larger engagements nearer the ends of the roller produce locally larger surface velocities of the paper through the nip, thereby tending to compensate for humidity-induced paper swelling by having all portions of the paper spend substantially the same time passing through the nip. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than midway along their length. This also tends to produce greater overdrive towards the ends of the rollers. However, the amount of extra overdrive from roller bending is not normally sufficient to compensate for humidity-induced paper swelling, and therefore a profiling of the thickness of the elastomeric coating in the axial direction, as described above, is often practiced.

As previously mentioned, PDMS cushion layers may include fillers comprising inorganic particulate materials, for example, metals, metal oxides, metal hydroxides, metal salts, and mixtures thereof. For example, U.S. Pat. No. 5,292,606 the disclosure of which is incorporated herein by reference, describes fuser roller base-cushion layers that contain fillers comprising particulate zinc oxide and zinc oxide-aluminum oxide mixtures. Similarly, U.S. Pat. No. 5,336,539, the disclosure of which is incorporated herein by reference, describes a fuser roller cushion layer containing dispersed nickel oxide particles. Also, the fuser roller described in U.S. Pat. No. 5,480,724, the disclosure of which is incorporated herein by reference, includes a base-cushion layer containing 20 to 40 volume percent of dispersed tin oxide particles.

Filler particles may also be included in a barrier layer. For example, in Chen et al., U.S. Pat. No. 5,464,698, the disclosure of which is incorporated herein by reference, is described a toner fuser member having a silicone rubber cushion layer and an overlying layer of a cured fluorocarbon polymer in which is dispersed a filler comprising a particulate mixture that includes tin oxide.

Chen et al., in commonly assigned U.S. patent application Ser. No. 08/879,896 disclose an improved fuser roller including three concentric layers each comprising a particulate filler, i.e., a base-cushion layer comprising a condensation-cured PDMS, a barrier layer covering the base cushion and comprised of a cured fluorocarbon polymer, and an outer surface layer comprising an addition-cured PDMS, the particulate fillers in each layer including one or more of aluminum oxide, iron oxide, calcium oxide, magnesium oxide, tin oxide, and zinc oxide. The barrier layer, which may comprise a Viton™ elastomer (sold by DuPont) or a Fluorel™ elastomer (sold by Minnesota Mining and Manufacturing), is a relatively low modulus material typically having a Young's modulus less than about 10 MPa, and it therefore has a negligible effect upon the mechanical characteristics of the roller, including overdrive.

Vrotacoe et al., in U.S. Pat. No. 5,553,541, disclose a printing blanket, for use in an offset printing press, which includes a seamless tubular elastic layer comprising compressible microspheres, surrounded by a seamless tubular layer made of a circumferentially inextensible material, and a seamless tubular printing layer over the inextensible layer. It is disclosed that provision of the inextensible layer reduces or eliminates pre-nip and post-nip bulging of the roller when printing an ink image on a receiver sheet, thereby improving image quality by reducing or eliminating ink smearing caused by slippage associated with the formation of bulges in the prior art.

To improve image quality, and also to reduce wear and aging and thereby prolong the life of a compliant roller in a fusing station, there remains a need for a compliant externally heated fusing roller or compliant pressure roller for use in electrostatography having a reduced or negligible propensity to exhibit overdrive behavior when engaged in a fusing nip with a noncompliant roller, or with another compliant roller. There also remains a need to provide rollers for a fusing station, which provide improved insensitivity of fusing uniformity to roller flexure. There particularly remains a need for an externally-heated compliant toner fuser roller that has a negligible propensity to produce overdrive-induced image defects, either large-scale or small-scale, when used with a relatively non-compliant pressure roller. Moreover, there is also a need for such an overdrive-controlling externally heated fuser roller to be able to provide an axially varying differential overdrive, in order to compensate for a humidity induced nonuniform swelling of receivers.

SUMMARY OF THE INVENTION

To meet these needs, the invention provides an improved fusing station of an electrostatographic machine using an externally heated fuser roller, the fusing station rollers including a thin, flexible stiffening layer. The fusing station includes a conformable or compliant multilayer roller, which has a high modulus-stiffening layer located near or at the surface of the roller and a preferably substantially incompressible blanket layer. The multilayer roller can be an externally heated fuser roller, or a pressure roller. By reducing or eliminating the surface stretching of a compliant roller in a fusing nip, the stiffening layer provides improved image quality resulting from a dramatically reduced propensity for overdrive. Because of the reduced overdrive, a roller of the invention wears much more slowly and has longer operational life than a prior art roller having no stiffening layer. Moreover, a stiffening layer included in a compliant roller of the invention provides an improved ability to mask certain types of irregularities of underlying layers, such as, for example, certain types of runout produced during the manufacture of a core member, thereby allowing some manufacturing tolerances to be less stringent, reducing costs. A stiffening layer included in a compliant roller of the invention also provides an improved insensitivity of fusing uniformity to roller flexure.

Preferably, the stiffening layer of an externally heated fuser roller according to the invention is made of a thin high-modulus material having good thermal conductance so as to provide the roller with a more uniform surface temperature, and hence an improved fusing uniformity. An improved fusing station of the invention may include an externally heated compliant fuser roller having a stiffening layer and a compliant pressure roller having a stiffening layer, or an externally heated compliant fuser roller having a stiffening layer and a hard pressure roller. Also, an externally heated hard fuser roller may be used with a compliant pressure roller having a stiffening layer. A multilayer roller having a stiffening layer may be used in simplex and duplex fusing stations. In a duplex station, each of the rollers forming the fusing nip is externally heated and may have a stiffening layer.

In accordance with the invention there is provided a conformable roller for use in a fusing station of an electrostatographic machine, wherein the fusing station is provided with a pressure roller and a fuser roller for fusing a toner image on a receiver, the fuser roller being made from a plurality of layers surrounding an axis of rotation, the conformable roller including: a rigid cylindrically symmetric core member; a compliant base-cushion layer formed on the core member; a stiffening layer in intimate contact with and surrounding the base-cushion layer; a compliant release layer coated on the stiffening layer; and, wherein the fusing station includes an external heat source for the fuser roller, with at least one of the plurality of layers being thermally resistive.

In accordance with a further aspect of the invention, there is provided a fusing station of an electrostatographic machine which includes: a rotating externally heated compliant fuser roller, the compliant fuser roller including a base-cushion layer surrounding a rigid cylindrical core member, a stiffening layer in intimate contact with the base-cushion layer such that the stiffening layer has a Young's modulus in a range of approximately 0.1 GPa to 500 GPa and a thickness less than about 500 micrometers, and an outer compliant layer surrounding the stiffening layer; and, a counter-rotating hard pressure roller engaged to form a fusing nip with the compliant fuser roller.

In accordance with another aspect of the invention, there is provided a fusing station of an electrostatographic machine which includes: a rotating externally heated compliant fuser roller including a base-cushion layer surrounding a rigid cylindrical core, a stiffening layer in intimate contact with the base-cushion layer such that the stiffening layer has a Young's modulus in a range of approximately 0.1 GPa to 500 GPa and a thickness less than about 500 micrometers, and an outer compliant release layer surrounding the stiffening layer; and, a counter-rotating compliant pressure roller engaged to form a fusing nip with the compliant fuser roller including a base-cushion layer surrounding a rigid cylindrical core, a stiffening layer in intimate contact with the base-cushion layer such that the stiffening layer has a Young's modulus in a range of approximately 0.1 GPa to 500 GPa and a thickness less than about 500 micrometers, and an optional outer compliant layer surrounding the stiffening layer.

In accordance with yet another aspect of the invention, there is provided a fusing station of an electrostatographic machine which includes: a rotating compliant pressure roller including a base-cushion layer surrounding a rigid cylindrical core member, a stiffening layer in intimate contact with the base-cushion layer such that the stiffening layer has a Young's modulus in a range of approximately 0.1 GPa to 500 GPa and a thickness less than about 500 micrometers, and an outer compliant layer surrounding the stiffening layer; and, a counter-rotating externally heated hard fuser roller engaged to form a fusing nip with the compliant pressure roller.

In accordance with a still further aspect of the invention, there is provided a fusing station of an electrostatographic machine which includes: a rotating first heated fuser roller; a counter-rotating second heated fuser roller engaged to form a pressure fusing nip with the first fuser roller; wherein at least one of the first and second heated fuser rollers further includes a base-cushion layer surrounding a rigid cylindrical core member, a stiffening layer in intimate contact with the base-cushion layer such that the stiffening layer has a Young's modulus in a range of 0.1 GPa to 500 GPa and a thickness less than about 500 micrometers, and an outer compliant release surrounding the stiffening layer; and, wherein at least one of the first and second heated fuser rollers is heated by an external source of heat.

In accordance with still yet another aspect of the invention, there is provided a toner fusing method, for use in an electrostatographic machine having a fusing station according to claim 16 the toner fusing method including the steps of: forming a fusing nip by engaging the rotating compliant fuser roller having an external source of heat and the counter-rotating hard pressure roller, one of the rollers being a driven roller and the other frictionally driven by pressure contact in the nip; forming an unfused toner image on a surface of a receiver sheet; feeding the leading edge of the receiver into the nip and allowing the unfused toner image on the receiver sheet to pass through the fusing nip with the unfused toner image facing the fuser roller; wherein the compliancy in combination with the stiffening layer included in the fuser roller provide a reduced wear rate of the fuser roller and an improved quality of a toner image fused by the fusing station.

In accordance with yet another further aspect of the invention, there is provided a method of making a compliant roller of claim 1 including the steps of: providing the core member with the base-cushion layer formed on the core member by coating the base-cushion layer uniformly on the core member; providing a cylindrical mandrill and then mounting on the mandrill the stiffening layer in the shape of a seamless metal tube having an inner diameter prior to mounting the stiffening layer on the mandrill which is smaller than the outside diameter of the base-cushion layer formed on the core member; uniformly coating the stiffening layer by the release layer; sliding the stiffening layer coated by the release layer over the base-cushion layer formed on the core member to a suitable position on the base-cushion layer to create a completed roller, the sliding being accomplished by making the inner diameter of the stiffening layer coated by the release layer temporarily larger during the sliding than the outer diameter of the base-cushion layer formed on the core member.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1:
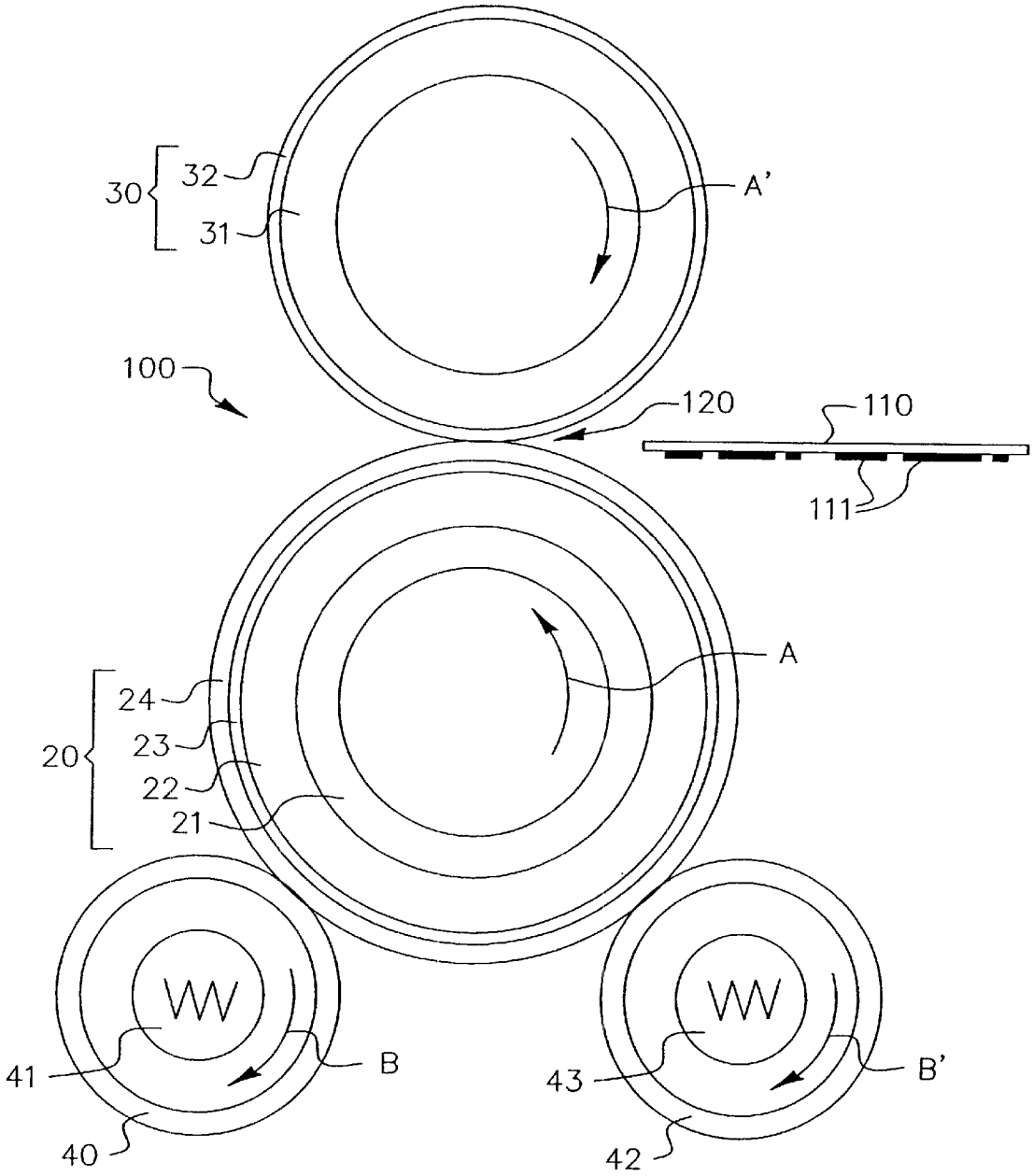
FIG. 1 depicts an end view of a simplex toner fusing station according to this invention, which includes a hard pressure roller engaged in a fusing nip with an externally-heated compliant fuser roller which has a seamless stiffening layer.

Fusing stations according to this invention are readily usable in typical electrostatographic reproduction apparatus of many types such as described above.

Because such reproduction apparatus are well known, the present description will be directed in particular to subject matter forming part of, or cooperating more directly with, the present invention.

The invention relates to electrostatographic reproduction utilizing a fusing station to thermally fuse an unfused toner image to a receiver, e.g., paper. The fusing station preferably comprises two rollers, which are engaged to form a fusing nip in which an externally heated fuser roller comes into direct contact with the unfused toner image as the receiver is frictionally moved through the nip. The externally heated roller is heated by a heat source, which preferably comprises one or more heating rollers in contact with it. Alternatively, the heat source may be external radiation absorbed by the fuser roller, e.g., as provided by one or more lamps, or any other suitable external heating source. The receiver may be a cut sheet or it may be a continuous web. The unfused toner image may include a single-color toner or it may include a composite image of two or more single-color toners, e.g., a full color composite image made for example from black, cyan, magenta, and yellow toners. The unfused toner image is previously transferred, e.g., electrostatically, to the receiver from a toner image-bearing member such as a primary image-forming member or an intermediate transfer member. The electrostatographic reproduction may utilize a photoconductive electrophotographic primary image-forming member or a non-photoconductive electrographic primary image-forming member. Particulate dry or liquid toners may be used.

A simplex fusing station of the invention may include several embodiments. In a preferred embodiment, there is shown a compliant externally heated fuser roller which has a stiffening layer, engaged in a fusing nip with a hard pressure roller. In this embodiment, a distorted shape of the compliant roller in the nip helps to release the receiver from the fuser roller and tends to guide it more towards the hard pressure roller as the receiver passes out of the nip. In two other preferred embodiments, a hard externally heated fuser roller is engaged in a fusing nip with a compliant pressure roller which includes a stiffening layer, or a compliant externally heated fuser roller which includes a stiffening layer is engaged in a fusing nip with a compliant pressure roller which also includes a stiffening layer. A simplex fusing station of the invention can be used to fuse an unfused toner image to one side of a receiver, which already has a previously fused toner image on the reverse side.

A preferred embodiment of a duplex fusing station of the invention includes a compliant externally heated first fuser roller which has a stiffening layer, engaged in a fusing nip with a compliant externally heated second fuser roller which has a stiffening layer. The duplex fusing station simultaneously fuses two unfused toner images, one on the front and one on the back of the receiver.

In other embodiments, the stiffening layer of a roller of a fusing station is provided with an axial variation of stiffness, i.e., having a variation parallel to the roller axis, the stiffness being measured parallel to a tangential direction of rotation of the roller. It is preferred that the stiffness of the stiffening layer is greatest midway along the length of the roller, and least near each end of the roller.

In additional embodiments, a roller of a fusing station is provided with a stiffening layer, which is located at different depths along the length of the roller. It is preferred for a fusing roller that the stiffening layer is located deepest near each end of the roller and shallowest substantially midway along the length of the roller.

In still other embodiments, a roller of a fusing station, which includes a stiffening layer, is provided with an outside diameter varying along a direction parallel to the roller axis. Preferably, a maximum of said outside diameter of a fuser roller is located near each end of the roller and a minimum is located substantially midway along the length of the roller.

In further embodiments, an externally heated fuser roller includes a stiffening layer, which is shorter than the length of a receiver measured parallel to the fuser roller axis when the fuser roller is being utilized for fusing a toner image to a receiver.

In all embodiments, inventive rollers are preferably cylindrically symmetrical, i.e., a cross-section of the roller taken at right angles to the roller axis anywhere along the length of the roller has radial symmetry around the roller axis.

Although not explicitly disclosed in the preferred embodiments, it will be understood that an optional supplementary source of heat for fusing, either external or internal, may be provided to any roller included in a fusing station of the invention.

Referring now to the accompanying drawings, FIG. 1 shows a preferred embodiment of an inventive simplex fuser station, designated by the numeral 100. A rotating fuser roller 20 moving in the direction indicated by arrow A includes a plurality of layers disposed about an axis of rotation, the plurality of layers including a cylindrical core member 21, a relatively thick compliant base-cushion layer 22 formed on the core, a seamless stiffening layer 23 in intimate contact with and surrounding the base-cushion layer 22, and a compliant release layer or outer compliant layer 24 coated on the stiffening layer. (Henceforth, the terms "release layer" and "outer compliant layer" are used interchangeably and mean the same thing). The surface of roller 20 is externally heated by a heat source in the form of contacting counter-rotating cylindrical heating rollers 40 and 42 moving in the directions of the indicated arrows B and B' and including corresponding interior heating elements 41 and 43. A counter-rotating hard pressure roller 30 moving in the direction of arrow A' forms a fusing nip 120 with compliant fuser roller 20. A receiver sheet 110 carrying an unfused toner image 111 facing the fuser roller 20 is shown approaching nip 120. The receiver sheet is fed into the nip by employing well known mechanical transports (not shown) such as a set of rollers or a moving web for example. The fusing station preferably has one driving roller, the other rollers being 10 driven and rotated frictionally by contact with the driving roller. For instance, the driving roller may be fuser roller 20, with rollers 30, 40 and 42 being driven rollers.

At least one of any layers located outward of the axis of rotation of the fuser roller 20 is thermally resistive. Preferably, base-cushion layer 22 is thermally resistive. A thermally resistive layer as described herein is a layer having a thermal conductivity of less than or equal to about 0.4 BTU/hr/ft/°F.

Although two heating rollers 40 and 42 are shown in FIG. 1, one or more heating rollers may be used. A heating roller is made from any suitable thermally conductive rigid material, preferably aluminum, and may further include a preferably thermally stable low surface energy thin polymeric coating on its surface, e.g., a fluoroelastomer or a silicone rubber, typically less than about 1.25 mm thick (not shown in FIG. 1). A tubular heating roller is preferred. A heating element in the interior of a heating roller may include an axially centered tubular incandescent heating lamp, e.g. lamps 41 and 43, or an ohmically heated resistive filament, or other suitable interior source of heat. Preferably, the heat source is controlled by a feedback circuit, for example by utilizing a thermocouple (not shown) to monitor and thereby control the surface temperature of fuser roller 20 by employing a programmable voltage power supply (not shown) to regulate the temperature of the lamps 41 and 43.

The pressure roller 30 includes a core member 31 and an optional surface layer 32 coated on the core. The core may be made of any suitable rigid material, e.g., aluminum, preferably including a cylindrical tube. Optional surface layer 32 is preferred to be less than 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, layer 32 may include a relatively hard poly(tetrafluoroethylene) or other suitable polymeric coating. A bare core having no layer 32 may include, for example, anodized aluminum or copper.

The fuser roller 20 includes a rigid core member preferably in the form of a cylindrical tube 21 made from any suitable material, e.g., aluminum The core member may have internal reinforcing members, e.g., struts, or other internal strengthening structures (not shown). Coated on the core member 21 is a relatively thick compliant base-cushion layer (BCL) designated 22. To promote adhesion between the core and the BCL 22, a thin primer layer (not shown in FIG. 1) may be used, such as for example made from air-dried GE 4044 priming agent (sold by General Electric). In intimate contact with and surrounding the BCL is a thin stiffening layer 23. Intimate contact is defined as an interface substantially free of bubbles or voids, and may be adhesive or non-adhesive. Coated on the stiffening layer (SL) 23 is a relatively thin release layer or outer compliant layer (OCL) designated 24. The BCL 22 and OCL 24 may be the same or different compliant materials.

The base-cushion layer 22 may include any suitable thermally stable elastomeric material, such as a single-phase elastomeric material, or it may include an elastomeric material consisting of more than one phase, e.g., a two-phase material such as a closed-cell foam, or a material in which the second phase is a particulate filler dispersed in an elastomer. The BCL 22 may be a fluoroelastomer, e.g., a Viton™ (from DuPont) or a Fluorel™ (from Minnesota Mining and Manufacturing). Alternatively, the BCL 22 may include a rubber, such as an EPDM rubber made from ethylene propylene diene monomers, or an EPDM rubber further including a particulate filler, preferably of iron oxide. The BCL 22 may also include an addition cured silicone rubber with a chromium (III) oxide filler. However, it is preferred that the BCL includes a condensation-cured poly (dimethylsiloxane) elastomer further including a filler which can be aluminum oxide, iron oxide, calcium oxide, magnesium oxide, nickel oxide, tin oxide, zinc oxide, or mixtures thereof. This filler preferably includes particles having a mean diameter in a range of approximately between 0.1 micrometer and 100 micrometers and occupying 3 to 30 volume percent of the base-cushion layer, and more preferably, a mean diameter between 0.5 micrometer and 40 micrometers and occupying 5 to 20 volume percent of the base-cushion cushion layer. In a preferred embodiment, the filler includes zinc oxide particles. The base-cushion layer 22 preferably has a thickness between 0.25 mm and 25 mm, and more preferably, between 1.25 mm and 12.5 mm. The BCL 22 preferably has a thermal conductivity less than 0.4 BTU/hr/ft/°F., and more preferably, in a range of approximately between 0.1 BTU/hr/ft/°F.–0.3 BTU/hr/ft/°F. The BCL 22 also has a Poisson's ratio preferably in a range between approximately 0.2 and 0.5, and more preferably, between 0.45 and 0.5. In addition, the base-cushion layer preferably has a Young's modulus in a range of approximately 0.05 MPa–10 MPa, and more preferably, 0.1 MPa–1 MPa.

The stiffening layer 23 can include any suitable material, including metal, elastomer, plastic, woven material, fabric, cordage, mesh, or reinforced material such as, for example, a reinforced silicone rubber belt. A cordage may include a continuous strand of any suitable material or a portion thereof wound around the roller, where the number of windings per unit length along the roller may be systematically varied. Alternatively, a cordage, may include individual rings or loops of any suitable material, the loops being concentric with the roller axis, and the number of loops per unit length along the roller may be systematically varied. A material, which is impervious to penetration by fuser oil, is preferred, inasmuch as it is known that elevated temperature contact with fuser oil can deleteriously affect a base-cushion layer and cause it to have a reduced operational life. It is preferred that the SL has good thermal conductance, which helps to reduce variations in temperature near the surface of the roller and thereby improves fusing uniformity and image quality. The stiffening layer 23 may be adhesively bonded to the BCL 22. The SL 23 preferably includes a suitably flexible high-modulus metal or plated metal, and can be made, for example, from the group of metals including copper, gold, steel, and more preferably, nickel, or other suitable metals. The SL 23 may also include a sol-gel or a ceramer or an elastomer such as for example a polyurethane, a polyimide, a polyamide or a fluoropolymer, the SL having a yield strength which is not exceeded during operation of the fuser roller. The stiffening layer preferably has the form of a seamless endless belt. The stiffening layer may also include a sheet wrapped around the base-cushion layer and smoothly joined by a seam to create an endless belt, and the seam may have an adhesive or a weld. It is preferable that the stiffening layer has a thickness less than about 500 micrometers, and more preferably, in a range of approximately between 75 micrometers–250 micrometers. The Young's modulus of SL 23 is preferably in a range of approximately between 0.1 GPa and 500 GPa, and more preferably, 10 GPa–350 GPa.

The outer compliant layer or compliant release layer 24 of fuser 20 preferably has a highly smooth outermost surface. The OCL 24 is preferred to be highly resistant to abrasion, and can include any suitable elastomeric material preferably having a low surface energy, such as for example a silicone rubber, or a fluoroelastomer. The OCL 24 may include for example a PDMS, preferably an addition-cured poly (dimethylsiloxane) elastomer and silica and titania fillers. The OCL has a roughness value, Ra, no greater than about 10microinches, as determined by measurements on a 15-inch long roller using a Federal Surfanalyzer 4000 Profilometer provided with a transverse chisel stylus moving at a speed of 2.5 mm/sec. A release layer 24 providing suitable smoothness, of which the composition and coating method are disclosed by Chen et al. in commonly assigned U.S. patent application Ser. No. 08/879,896 may include Silastic™ E RTV silicone rubber available from Dow Corning Corporation. The compliant release layer has a thickness preferably less than 1 millimeter, and more preferably in a range of approximately between 25 micrometers and 250 micrometers. The OCL 24 preferably has a thermal conductivity in a range of approximately between 0.2 BTU/hr/ft/°F.–0.5 BTU/hr/ft/°F., and a Young's modulus of approximately between 0.05 MPa and 10 MPa, more preferably 0.1 MPa–1 MPa. The Poisson's ratio of the OCL is preferably in a range of between approximately 0.4 and 0.5, and more preferably, between 0.45 and 0.5. The compliant release layer 24 further includes a particulate filler which can be aluminum oxide, iron oxide, calcium oxide, magnesium oxide, nickel oxide, tin oxide, zinc oxide, copper oxide, titanium oxide, silicon oxide, graphite, and mixtures thereof, and preferably zinc oxide. The particulate filler preferably occupies approximately 5 to 50 volume percent of the release layer, and more preferably, 10 to 35 volume percent. Preferably, the filler helps to provide good thermal conductivity in the OCL 24, which reduces variations in temperature near the surface of the fuser roller 20 and thereby improves fusing uniformity and image quality.

If the selected stiffening layer 23 is not impervious to fuser oil, an optional thin barrier layer (not shown in FIG. 1) may be coated on the stiffening layer underneath the OCL 24. The barrier layer preferably includes a fluoropolymer and 20 to 40 volume percent of a particulate filler. The fluoropolymer is preferably a random copolymer formed from mixtures of monomer units selected from vinylidene fluoride, tetrafluoroethylene, and hexafluoropropylene. The filler can be aluminum oxide, iron oxide, calcium oxide, magnesium oxide, nickel oxide, tin oxide, and mixtures thereof. Preferably the optional barrier layer has a thickness in a range of approximately 10 micrometers to 50 micrometers. The barrier layer can be thicker when coated on a stiffening layer including a semi-open structure such as a woven material or a fabric.

The preferred fuser roller 20 including a stiffening layer 23 in the form of an endless seamless belt is preferably made in three steps. The first step is to provide the core member 21 uniformly coated with the base-cushion layer 22. In the second step, the SL 23 in the shape of a seamless metal tube, preferably an electroformed belt preferably made of nickel available from Stork Screens America, Inc., of Charlotte, N.C., is mounted on a mandrill and uniformly coated with the release layer 24. The inner diameter of the as-purchased electroformed belt is a little smaller than the outside diameter of the BCL 22 on the core, typically about 300 micrometers smaller. In the third step, the electroformed belt coated by the OCL 24 is slid over the BCL 22 on the core to create a completed roller 20. To accomplish the third step, the inner diameter of the OCL-coated electroformed belt is temporarily made larger than the outer diameter of the base-cushion layer 22 as coated on the core member 21. For example, the core plus base-cushion layer may be cooled to a low temperature in order to contract it, so that the OCL-coated electroformed belt having a higher temperature can be slid into place. When the assembled roller is returned to room temperature, the stiffening layer is placed under tension so as to snugly and uniformly clasp the BCL. Alternatively, the third step can be accomplished by using any well-known compressed air assist technique to elastically stretch the OCL-coated electroformed tube slightly so that it can be slid into place. In order to aid sliding, a lubricating aid may be applied to either the BCL outer surface or the inner surface of the SL belt. Lubricating aids include materials, which can produce a low-surface-energy-sliding interface, such as for example sub-micron particles of silica and the like, zinc stearate, or other suitable materials. After the coated SL 23 is satisfactorily placed in a suitable position on the base-cushion layer 22, and the compressed air turned off, the stretched SL relaxes and grips the base-cushion layer snugly. Although the SL 23 in its final position after the third step is preferably in intimate non-adhesive contact with the BCL 22, an adhesive coating may be applied to the BCL surface in order to adhesively bond the SL to the BCL.

Figure 2:
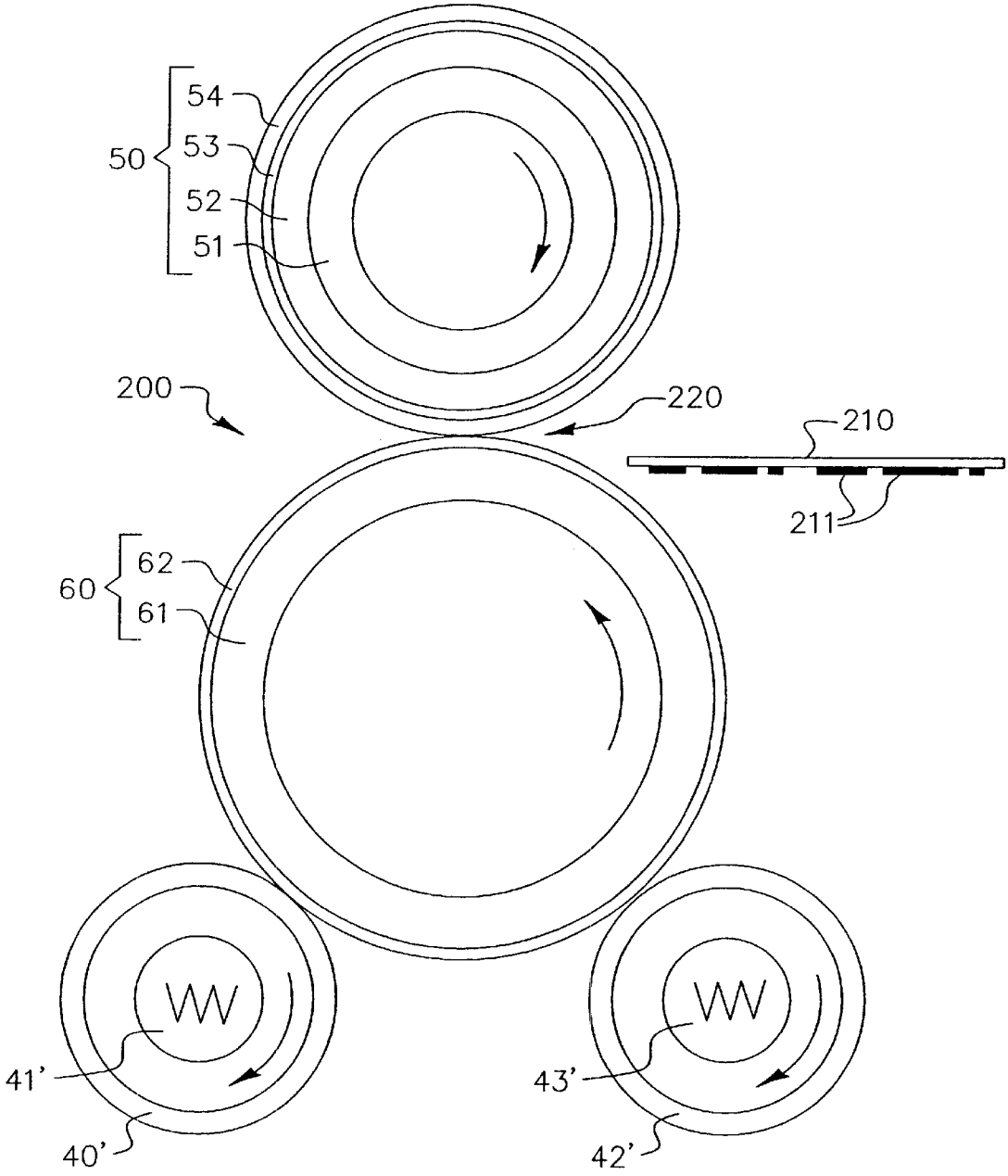
FIG. 2 depicts an end view of a simplex toner fusing station according to this invention, which includes an externally-heated hard fuser roller engaged in a fusing nip with a compliant pressure roller which has seamless stiffening layer.

A second preferred embodiment of an inventive simplex fusing station is designated as 200 in FIG. 2. Fusing station 200 includes an externally heated hard fuser roller 60, and a compliant pressure roller 50 having a stiffening layer. Roller 60 is heated by an external source of heat, such as for example may be provided by contact with one or more heating rollers indicated as 40' and 42' with sources of heating indicated as internal incandescent lamps 41' and 43'. Here the primes indicate roller properties similar to those already described for heating rollers 40 and 42. A receiver sheet 210 carrying an unfused toner image 211 is shown approaching a fusing nip 220 formed by engaged rollers 50 and 60.

The fuser roller 60 includes a core member 61 and an optional surface layer 62 coated on the core. The core may be made of any suitable rigid material, e.g., aluminum, preferably in the form of a cylindrical tube. Optional surface layer 62 is preferred to be less than 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, layer 62 may include a relatively hard poly(tetrafluoroethylene) or other suitable polymeric coating.

The compliant pressure roller 50 includes a rigid cylindrical core member 51, preferably made from aluminum, a compliant base-cushion layer 52 coated on the core member, a stiffening layer 53 preferably in the form of a seamless endless belt in intimate contact with and surrounding base-cushion layer 52, and an optional outer compliant layer 54. The base-cushion layer 52 includes a suitable thermally stable elastomer, e.g., a fluoroelastomer, an EPDM rubber, a PDMS, or other suitable material preferably having thickness in a range of approximately between 0.25 mm and 25 mm. The BCL 52 preferably has a Young's modulus in a range of approximately 0.05 MPa to 10 MPa and may further include a particulate filler or a foam. Base-cushion layer 52 has a Poisson's ratio preferably in a range of between approximately 0.2 and 0.5 and more preferably between 0.45 and 0.5. The BCL and OCL may be the same or different compliant materials.

The stiffening layer 53 includes a thin, flexible, preferably high-modulus modulus material having characteristics similar to those disclosed above for stiffening layer 23 of FIG. 1. Preferably, the stiffening layer 53 is a seamless belt and is made of nickel.

The optional outer compliant layer 54 includes an elastomer, such as for example a PDMS or a fluoropolymer, having a thickness preferably less than 500 micrometers. Outer compliant layer 54 preferably has a Young's modulus in a range of approximately 0.05 MPa–10 MPa, and a Poisson's ratio preferably in the range of approximately between approximately 0.4 and 0.5 and more preferably between 0.45 and 0.5.

The preferred pressure roller 50 including a stiffening layer 53 in the form of an endless seamless belt is preferably made in three steps. The first step is to provide the core member 51 uniformly coated with the base-cushion layer 52. In the second step, the SL 53 in the shape of a seamless metal tube, preferably an electroformed belt preferably made of nickel available from Stork Screens America, Inc., of Charlotte, N.C., is mounted on a mandrill and uniformly coated with the release layer 54. The inner diameter of the as-purchased electroformed belt is a little smaller than the outside diameter of the BCL 52 on the core 51, typically about 300 micrometers smaller. In the third step, the electroformed belt coated by the OCL 54 is slid over the BCL 52 on the core to create a completed roller 50. To accomplish the third step, the inner diameter of the OCL-coated electroformed belt is temporarily made larger than the outer diameter of the base-cushion layer 52 as coated on the core member 51. For example, the core plus base-cushion layer may be cooled to a low temperature in order to contract it, so that the OCL-coated coated electroformed belt having a higher temperature can be slid into place. When the assembled roller is returned to room temperature, the stiffening layer is placed under tension so as to snugly and uniformly clasp the BCL. Alternatively, the third step can be accomplished by using any well-known compressed air assist technique to elastically stretch the OCL-coated electroformed tube slightly so that it can be slid into place. In order to aid sliding, a lubricating aid may be applied to either the BCL outer surface or the inner surface of the SL belt. Lubricating aids include materials, which can produce a low-surface-energy-sliding interface, such as for example sub-micron particles of silica and the like, zinc stearate, or other suitable materials. After the coated SL 53 is satisfactorily placed in a suitable position on the base-cushion layer, and the compressed air turned off, the stretched SL relaxes and grips the base-cushion layer snugly. Although the SL 53 in its final position after the third step is preferably in intimate non-adhesive contact with the BCL 52, an adhesive coating may be applied to the BCL surface in order to adhesively bond the SL to the BCL.

Figure 3:
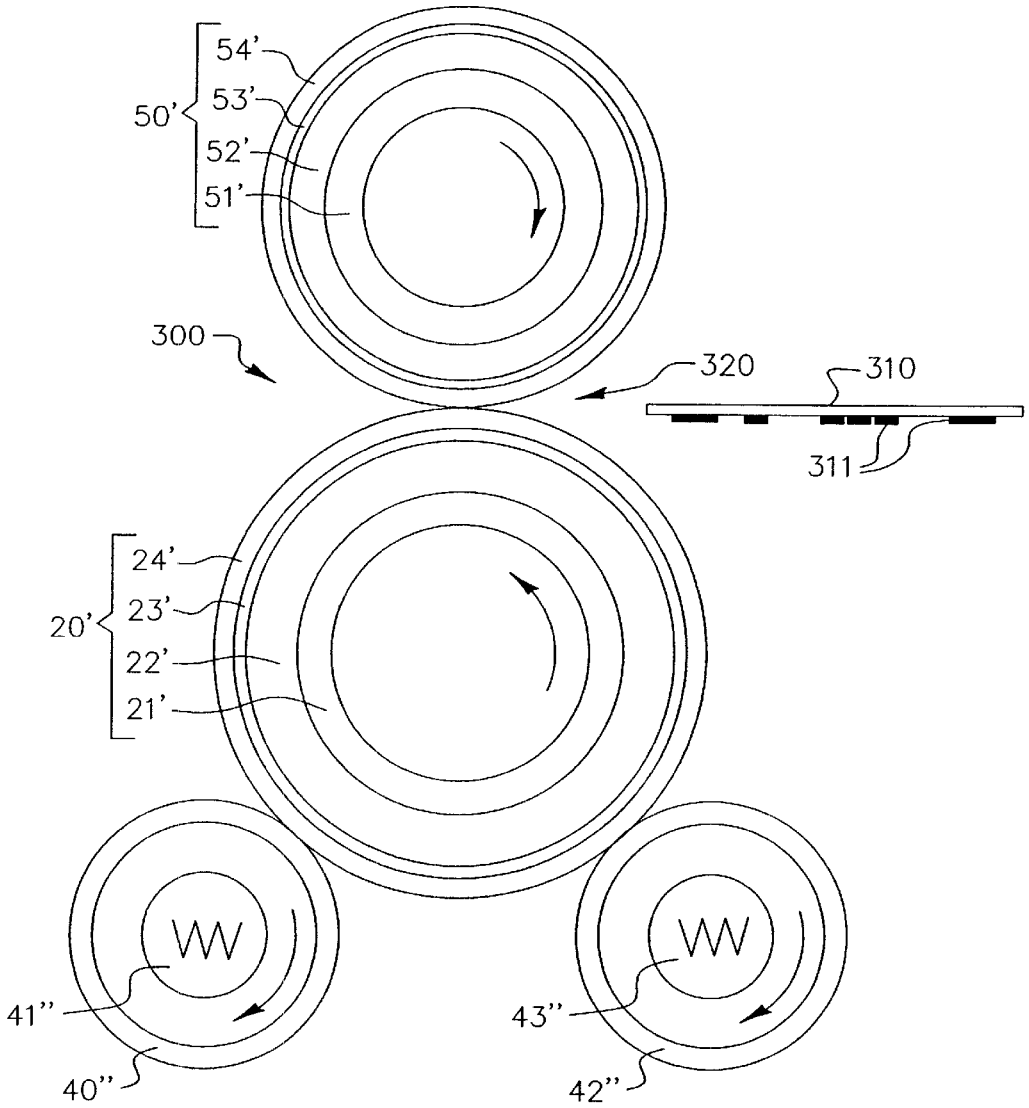
FIG. 3 depicts an end view of a simplex toner fusing station according to this invention, which includes an externally-heated compliant fuser roller which includes a seamless stiffening layer, engaged in a fusing nip with a compliant pressure roller which has a seamles stiffening layer.

A third preferred embodiment of an inventive simplex fusing station is shown in FIG. 3 designated as 300, in which single-primed (') and double-primed (") entities correspond to similar entities labeled by unprimed numerals in FIGS. 1 and 2. The material and physical characteristics of the singly-primed and doubly-primed entities are qualitatively and quantitatively the same as disclosed above for the unprimed entities, whereupon fusing station 300 includes an externally heated compliant fuser roller 20' having a stiffening layer preferably in the form of a seamless belt, and a compliant pressure roller 50' also having a stiffening layer preferably in the form of a seamless belt. Fuser roller 20' is heated by an external source of heat, such as for example may be provided by contact with one or more heating rollers labeled as 40" and 42" with sources of heating indicated as internal incandescent lamps 41" and 43". A receiver sheet 310 carrying an unfused toner image 311 is shown approaching a fusing nip 320 formed by engaged rollers 20' and 50'. Fuser roller 20' includes a plurality of layers disposed about an axis of rotation, the plurality of layers including a rigid cylindrical core 21', a base-cushion layer 22' formed on the core, a stiffening layer 2' in intimate contact with and surrounding the BCL 22', and a release layer 24' coated on the SL 23'. Pressure roller 50' includes a rigid cylindrical core 51', a base-cushion layer 52' formed on the core, a stiffening layer 53' in intimate contact with and surrounding the BCL 52', and an outer compliant layer 54' coated on the SL 53'. The base-cushion layer and outer compliant layer in each of rollers 20' or 50' may include the same or different compliant materials.

Figure 4:
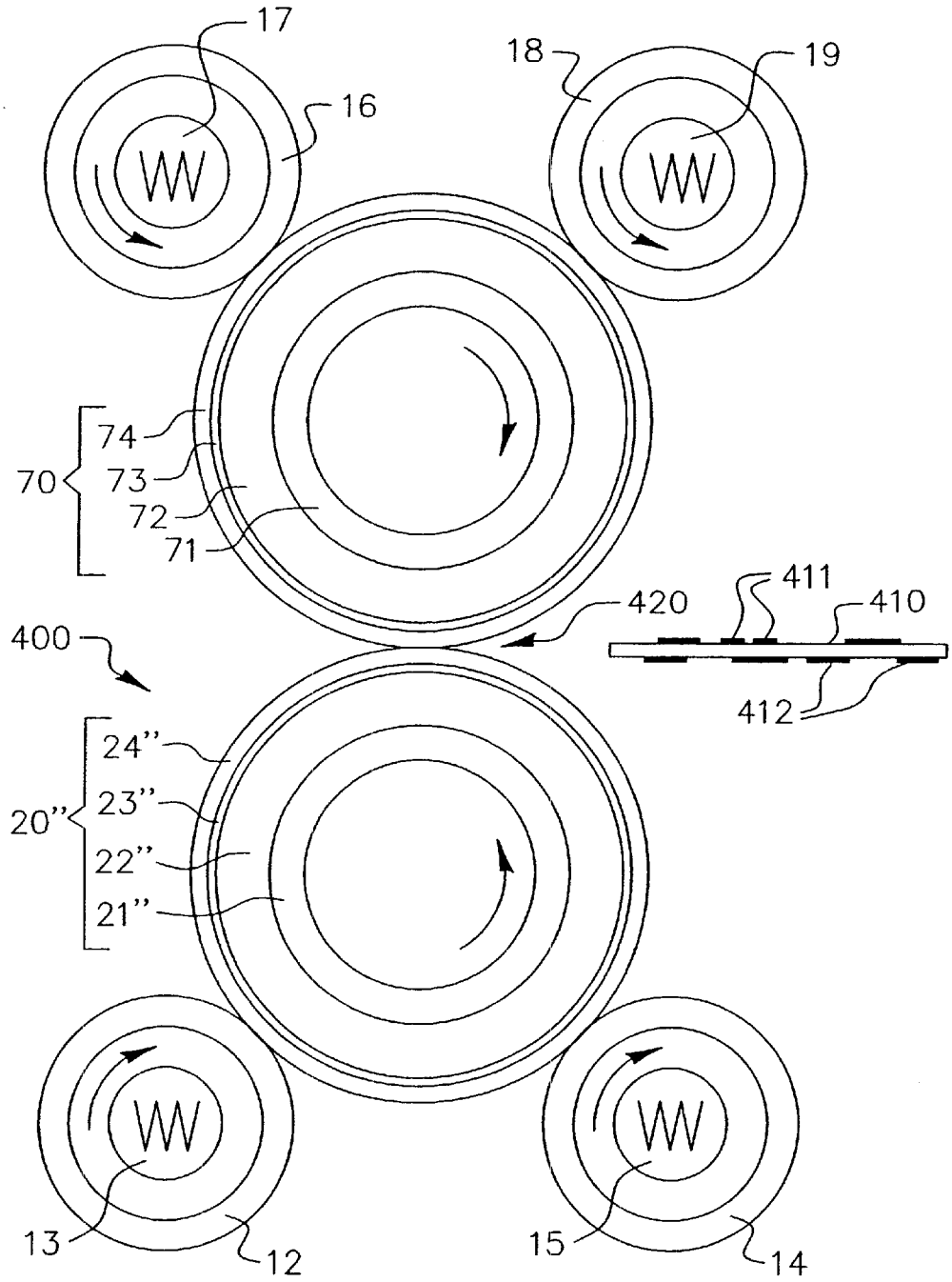
FIG. 4 depicts an end view of a duplex toner fusing station according to this invention, which includes an externally-heated compliant first fuser roller which has a seamless stiffening layer, engaged in a fusing nip with an externally-heated compliant second fuser roller which has a seamless stiffening layer.

A preferred embodiment of an inventive duplex fusing station designated as 400 is shown in FIG. 4. A first rotating fuser roller indicated as 20" includes a plurality of layers disposed about an axis of rotation, the plurality of layers including a rigid cylindrical core 21", a base-cushion layer 22" formed on the core, a stiffening layer 23" in intimate contact with and surrounding the base-cushion layer, and a release layer 24" coated on the stiffening layer. The double-primed entities correspond to similar entities labeled by unprimed numerals in FIG. 1, and the material and physical characteristics of the double-primed entities are qualitatively and quantitatively the same as those disclosed above for the unprimed entities. A second counter-rotating fuser roller 70 forms a fusing nip 420 with the first fuser roller 20". The second fuser roller has the same structure as the first fuser roller, i.e., it includes a plurality of layers disposed about an axis of rotation, the plurality of layers including a rigid cylindrical core 71, a base-cushion layer 72 formed on the core, a stiffening layer 73 in intimate contact with and surrounding the base-cushion layer, and a release layer 74 coated on the stiffening layer. The second fuser roller 70 is similar in other ways to the first fuser roller, inasmuch as it includes the same choices of materials and the same ranges of physical and material parameters as disclosed above for the fuser roller 20 of the first simplex embodiment (shown in FIG. 1). However, the two fuser rollers 20" and 70 may differ in specific dimensions, such as for example roller diameters, layer thicknesses, and so forth, and may also differ in specific choices of materials and material properties. In particular, the BCL and OCL in each roller may be made of the same or different compliant materials. Each of the fuser rollers is heated by an external source of heat, such as for example may be provided by contact with one or more heating rollers, indicated as 12 and 14 for roller 20" and 16 and 18 for roller 70, with sources of heating of the heating rollers 12 and 14 correspondingly indicated as internal incandescent lamps 13, 15, 17, and 19. A receiver sheet 411 is shown approaching fusing nip 420. On each side of the receiver 411 is an unfused toner image, labeled 411 and 412, respectively.

In the above disclosed preferred embodiments of inventive simplex and duplex fusing stations, the use of stiffening layers in compliant fuser and compliant pressure rollers reduces the propensity to overdrive, thereby markedly reducing wear as compared to prior rollers, especially of fuser rollers in contact with relatively hard and abrasive receivers such as paper. Image smear during fusing is also reduced and image quality thereby increased.

In order to help delineate the ranges of preferred parameters of the rollers according to the invention, such as layer thicknesses, Young's moduli, Poisson's ratios, and so forth, a finite element model of a fusing nip in which a compliant roller including a stiffening layer is engaged with a hard roller has been defined. Calculations using the model show, for example, that a minimum useful value of Young's modulus of a stiffening layer is very probably lower than 80,000 MPa. Therefore, in addition to a preferred metallic stiffening layer, a high-modulus non-metallic material can be useful.

In certain embodiments described below, it is advantageous to provide a stiffening layer having a stiffness that varies along the length of a roller along its longitudinal axis, in particular for an inventive fusing roller. It may also be advantageous to provide a variably stiff stiffening layer for a compliant pressure roller used in a fusing station of the invention. A variably stiff stiffening layer of a fuser roller can improve paper transport through a fusing station, particularly when paper receiver sheets are not perfectly rectangular as a result of humidity-induced swelling. A typical 8.5"×11" paper sheet has long paper fibers oriented substantially parallel to the 11" direction, and moisture penetrates preferentially into the 8.5" edges typically causing the nominally 8.5" edges to expand by about 1% to 2% compared to the nominal 8.5" width. It is usual practice to feed such paper sheets into a fuser nip with the 8.5" edges oriented parallel to the paper feeding direction, i.e., perpendicular to the roller axes. As a result, it typically takes a longer time for the swollen 8.5" edges to pass through the fusing nip than it does for the middle of the sheet. This can result in severe paper wrinkling and large-scale image defects. To correct this problem, it is preferred that all portions of the paper spend substantially the same time passing through the nip. A means to accomplish this is to provide a greater amount of overdrive near the swollen 8.5" edges of the paper than at the center. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than midway along their lengths. This also tends to produce greater overdrive towards the ends of the rollers. However, the amount of extra overdrive from roller bending is not normally sufficient to compensate for humidity-induced paper swelling, and embodiments having a variably stiff stiffening layer may be used.

In embodiments described below, a variably stiff stiffening layer is provided to produce a predetermined variation of overdrive along the length of a roller, e.g., to compensate for humidity-induced paper swelling. The variably stiff stiffening layer may be included in a fuser roller, e.g., rollers 20, 20', 20", or 70, or, in a pressure roller, e.g., rollers 50 or 50'. When a stiffening layer includes a cordage, a fabric, or a woven material, the spaces or interstices between cords or fibers may be filled by any suitable material, including a material of an adjacent layer of an inventive roller.

Figure 7:
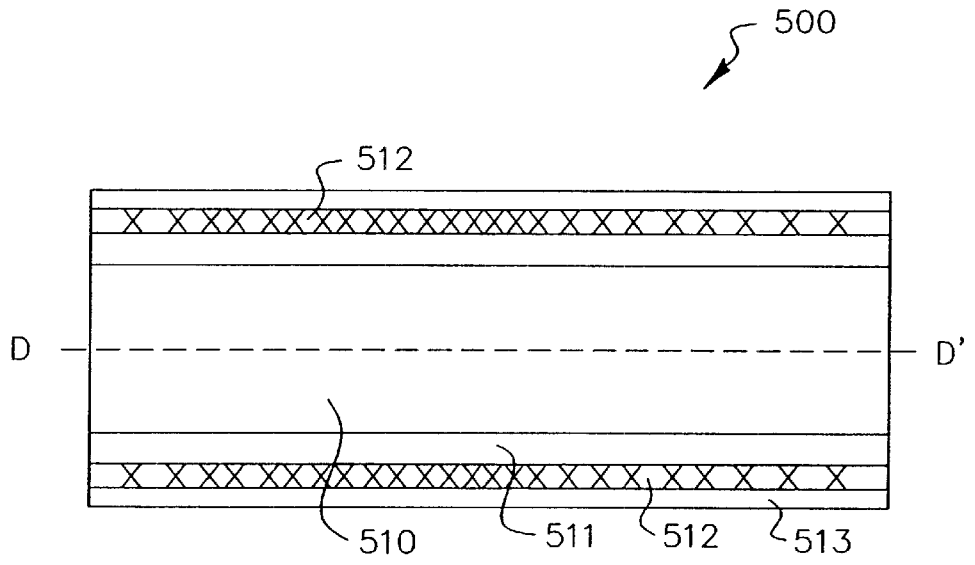
FIG. 7 shows a diagrammatic representation of a roller according to this invention, provided with a stiffening layer having a longitudinally variable Young's modulus.

In an embodiment utilizing a variably stiff stiffening layer, the stiffening layer of a roller of a fusing station according to the invention is provided with a Young's modulus that varies systematically parallel to the roller axis, the modulus being measured parallel to a tangential direction of rotation of the roller. It is preferred that the modulus of the stiffening layer of an inventive roller be greatest substantially midway along the length of the roller, and least near each end of the roller. As a result, when the roller is engaged in the fusing nip, there will be an increased amount of overdrive provided by the reduced stiffness of the stiffening layer near the edges of a paper sheet, as compared to the center of the paper, thereby providing a mechanism to ensure that all portions of the paper sheet spend substantially the same time passing through the nip. In this embodiment, the stiffening layer may include a continuous, thin, seamless metal tube in which the Young's modulus may be controlled, for example, by providing the metal as an alloy having a variable composition parallel to the roller axis. Alternatively, the stiffening layer may include a cordage in which the Young's modulus is changed systematically as a function of position along the roller, or the stiffening layer may include any other suitable material for which the Young's modulus can be systematically controlled and varied. FIG. 7 shows a longitudinal cross section of a diagrammatic representation of an exemplary inventive cylindrically symmetric roller, indicated as 500, provided with a stiffening layer 512 having a variable Young's modulus. Roller 500 includes a rigid core member 510, a compliant base-cushion layer 511 formed on the core member, a stiffening layer 512 surrounding and in intimate contact with the base-cushion layer 511 with stiffening layer 512 having a Young's modulus variable in a direction parallel to an axis of rotation indicated by D . . . D', and an outer compliant layer 513 on the stiffening layer. Stiffening layer 512 is shown with hatchings in which the density of hatching lines represents the magnitude of Young's modulus, with Young's modulus of stiffening layer 512 increasing from a minimum value at each end of the roller 500 towards a maximum value located at substantially the midpoint along the length of the roller. For clarity of understanding, the thickness of stiffening layer 512 has been greatly exaggerated. The longitudinal variation of Young's modulus of stiffening layer 512 may be smooth from an end of the roller 500 to substantially the midpoint, as indicated in FIG. 7, or it may have more or less abrupt changes. For example, individual longitudinal lengths or sections having discretely different Young's moduli may be used to make layer 512, where the individual lengths may be different materials. The individual longitudinal lengths need not be joined to form a continuous tube but may be separated by gaps, the gaps being preferably small enough so as to cause no noticeable effects at the exterior surface of compliant layer 513 that could result in a decreased fusing performance or quality. Moreover, the maximum value of Young's modulus may, if desired, extend for a suitable distance on either side of substantially the midpoint along the length of the roller 500.

Figure 8:
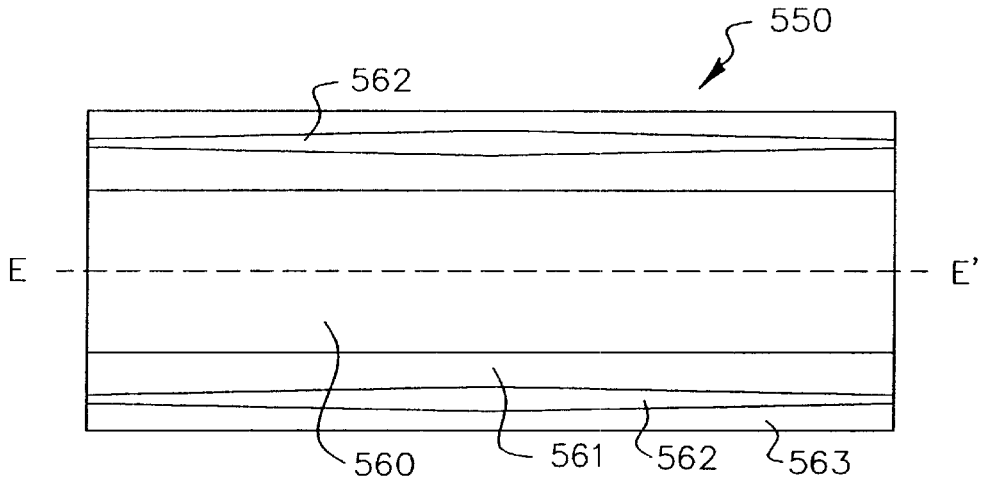
FIG. 8 shows a diagrammatic representation of a roller according to this invention, provided with a stiffening layer having a thickness that varies along the length of the roller.

In a further embodiment utilizing a variably stiff stiffening layer, the stiffening layer of a roller of a fusing station according to the invention is provided with a thickness that varies systematically parallel to the roller axis. It is preferred that the thickness of the stiffening layer of an inventive roller be greatest substantially midway along the length of the roller, and least near each end of the roller. As a result, when the roller is engaged in the fusing nip, there will be an increased amount of overdrive provided by the reduced thickness of the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the thickness may be systematically varied parallel to the roller axis. Alternatively, the stiffening layer may include a cordage in which the thickness of the cords is changed systematically as a function of position along the roller, or the stiffening layer may include any other suitable material for which the thickness can be systematically controlled and varied. FIG. 8 shows a longitudinal cross section of a diagrammatic representation of an exemplary inventive cylindrically symmetric roller, indicated as 550, provided with a stiffening layer 562 having a thickness that varies systematically parallel to the roller axis. Roller 550 includes a rigid core member 560, a compliant base-cushion layer 561 formed on the core member, a stiffening layer 562 surrounding and in intimate contact with the base-cushion layer 561 with the stiffening layer 562 having a thickness variable in a direction parallel to an axis of rotation indicated by E . . . E', and an outer compliant layer 563 on the stiffening layer. Stiffening layer 562 is shown with a thickness increasing from a minimum value at each end of the roller 550 towards a maximum value located at substantially the midpoint along the length of the roller. For clarity of understanding, the thickness of stiffening layer 562 has been greatly exaggerated along the entire length of the roller 550. The longitudinal variation of thickness of stiffening layer 562 may be smooth from an end of the roller 550 to substantially the midpoint, as indicated in FIG. 8, or it may have more or less abrupt changes. For example, individual longitudinal lengths or sections having discretely different thicknesses may be used to make layer 562. The individual longitudinal lengths need not be joined to form a continuous tube but may be separated by gaps, the gaps being preferably small enough so as to enough so as to cause no noticeable effects at the exterior surface of compliant layer 563 that could result in a decreased fusing performance or quality. Moreover, the maximum value of thickness of stiffening layer 562 may, if desired, extend for a suitable distance on either side of substantially the midpoint along the length of the roller 550. The stiffening layer 562 having a variable thickness may also include a mesh or a cordage (not illustrated) such that the diameters of the fibers, threads or wires of which the mesh or cordage is made are systematically varied so as to have a minimum diameter at or near each end of the roller 550 and a maximum diameter at substantially the midpoint along the length of roller 550.

Figure 9A:
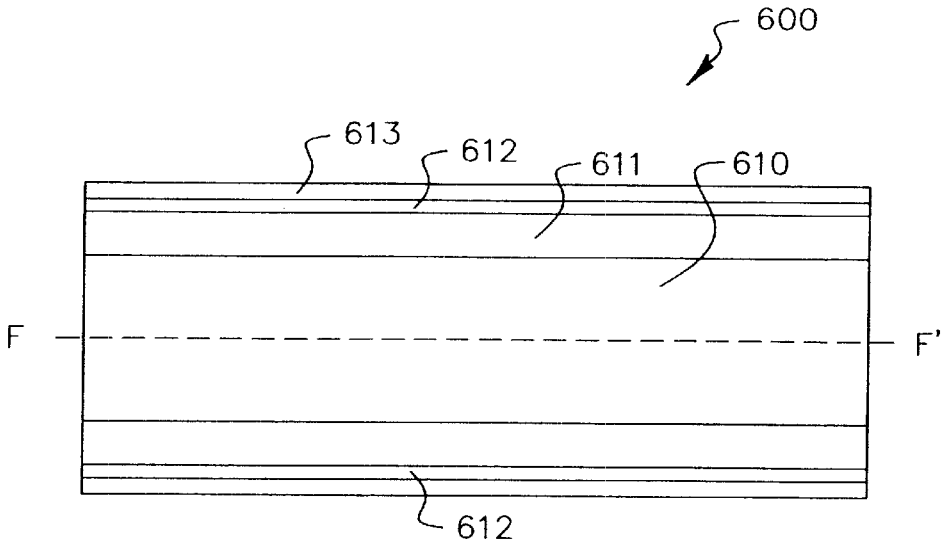
FIG 9*a* is a cross sectional view of a roller according to the invention illustrating the various layers.
Figure 9B:
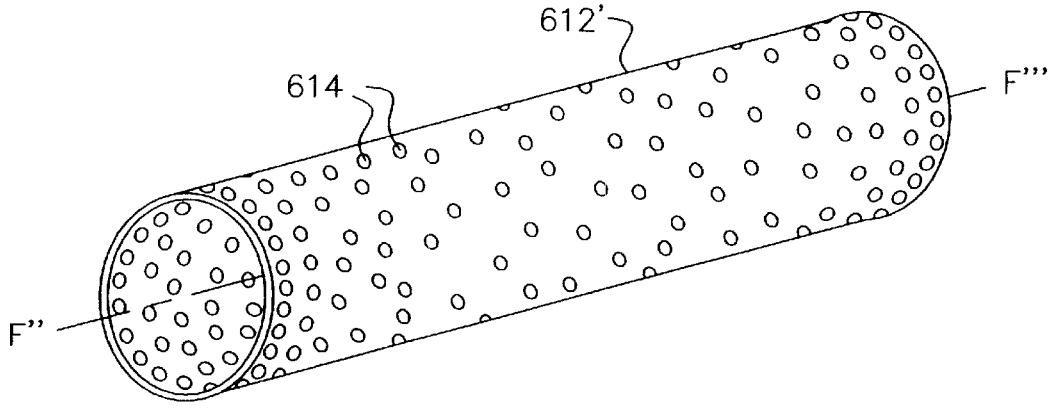
FIG. 9*b* shows a diagrammatic representation of a roller according to this invention, having a stiffening layer provided with a plethora of holes, with the combined area occupied by the holes varying along the length of the roller.

In another embodiment utilizing a variably stiff stiffening layer, the stiffening layer of a roller of a fusing station according to the invention is provided with a plethora of holes, preferably small holes, with the combined area occupied by the holes varying systematically along the length of the roller parallel to the roller axis. This may be accomplished by changing number of holes per unit area along the length of the roller, or by changing the area per hole along the length of the roller, or by a combination of variation of hole size and area per hole along the length of the roller. The holes may, therefore, have different sizes at different locations in the stiffening layer. It is preferred that the fractional area occupied by holes per unit length of an inventive roller be smallest substantially midway along the length of the roller, and greatest near each end of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the holes may be provided, e.g., formed by punching, drilling, etching, or by using a laser. Alternatively, the stiffening layer may include any other suitable material in which the holes can be systematically be provided, such as a plastic or reinforced material. FIG. 9*a* shows a longitudinal cross section of a diagrammatic representation of an exemplary inventive cylindrically symmetric roller, indicated as 600, having a stiffening layer 612 provided with a plethora of holes, preferably small holes, with the combined area occupied by the holes varying systematically per unit length along the length of the roller parallel to the roller axis. Roller 600 includes a rigid core member 610, a compliant base-cushion layer 611 formed on the core member, a stiffening layer 612 surrounding and in intimate contact with the base-cushion layer 611 with stiffening layer 612 having an area occupied by holes variable in a direction parallel to the roller axis of rotation indicated by F . . . F', and an outer compliant layer 613 on the stiffening layer. For clarity of understanding, an embodiment of a stiffening layer 612' is depicted in the tubular representation shown in FIG. 9, in which a number per unit area of similar-sized holes 614 is shown varying, in a direction parallel to axis F" . . . F'", from a maximum value at or near each end of the stiffening layer 612' towards a minimum value located at substantially the midpoint along the length of the stiffening layer. For clarity, only a few approximately round holes 614 having exaggerated sizes are indicated in FIG. 9, the holes preferably having diameters which are smaller than the thickness of the stiffening layer. The holes may have any suitable shapes, including random shapes. Different sized holes may be used at different locations, and holes of different sizes may be used together in any local area of the stiffening layer 612. For an inventive fuser roller, it is preferred that the holes be small enough to produce no measurable effect on fusing uniformity. It is to be understood that, in other suitable embodiments of stiffening layer 612 (not illustrated), a variation in the total fractional area occupied by holes along the length of the stiffening layer may be accomplished by varying the area per individual hole, or by combining a variation of the area per individual hole with a variation in the number of holes per unit area of the stiffening layer. The longitudinal variation along the length of the stiffening layer of the area occupied by holes may be smooth, as indicated for layer 612', or it may have more or less abrupt changes. For example, individual longitudinal lengths or sections having discretely different fractional hole areas may be used to make layer 612. The individual longitudinal lengths need not be joined to form a continuous tube but may be separated by gaps, the gaps being preferably small enough so as to enough so as to cause no noticeable effects at the exterior surface of compliant layer 613 that could result in a decreased fusing performance or quality. Moreover, the minimum value of the area occupied by holes per unit length of the stiffening layer 612 may, if desired, extend for a suitable distance on either side of substantially the midpoint along the length of the roller 600. Additionally, the minimum value of the number of holes per unit area provided or formed in the stiffening layer may be zero, such that holes may be provided or formed only near each end of the stiffening layer. When outer compliant layer 613 is formed on the stiffening layer, the material of layer 613 may be made to penetrate and fill the holes. Alternatively, the holes in the stiffening layer may be filled by any suitable other material, preferably a compliant material, and this is preferably done before the outer compliant layer 613 is formed on the stiffening layer 612.

Figure 10A:
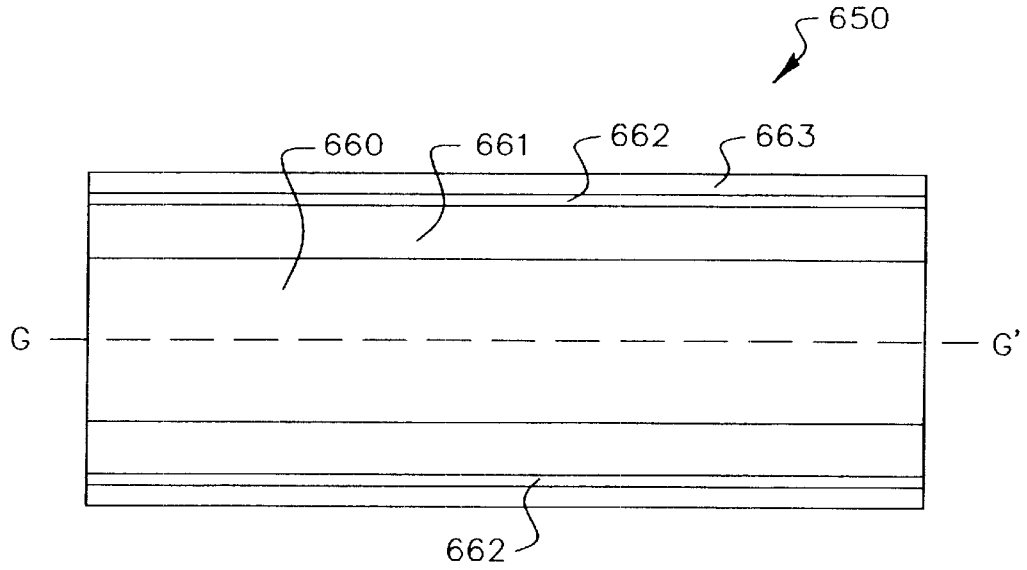
FIG. 10*a* is a cross sectional view of a roller according to the invention illustrating the various layers.
Figure 10B:
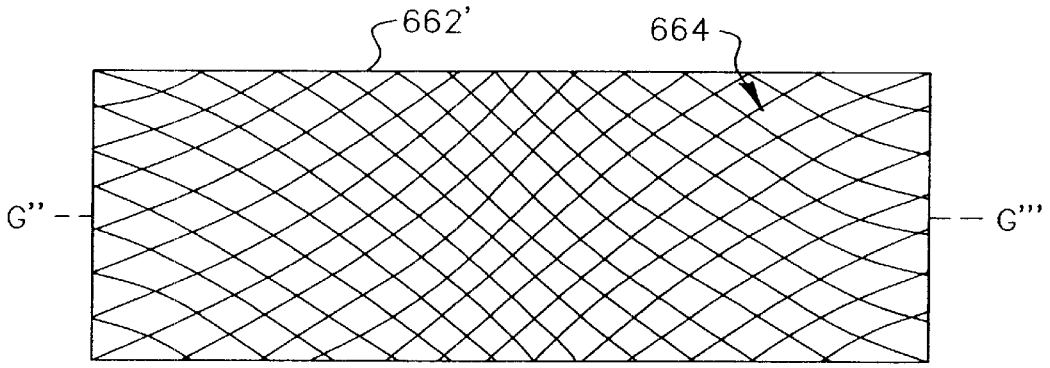
FIG. 10*b* shows a diagrammatic representation of a roller according to this invention, having a stiffening layer which includes a mesh or fabric in which the mesh density or fabric density is variable along the length of the roller.

In a further embodiment utilizing a variably stiff stiffening layer, the stiffening layer of a roller of a fusing station according to the invention includes a mesh or fabric in which the mesh density or fabric density is systematically variable along the length of the roller parallel to the roller axis. The density is proportional to the number of threads or wires per unit area, i.e., a high density in a given area of the mesh or fabric means a comparatively large number of threads or wires passing in any given direction, including sets of threads or wires that cross each other. It is preferred that the mesh or fabric density be lowest near the ends of an inventive roller, and highest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the fabric or mesh may include natural or synthetic fibers, threads, metal wires or strips, or any other suitable preferably flexible material which can be woven into a fabric or mesh having a variable density. FIG. 10*a* shows a longitudinal cross section of a diagrammatic representation of an exemplary inventive cylindrically symmetric roller, indicated as 650, having a stiffening layer 662 which includes a mesh or fabric in which the mesh density or fabric density is systematically variable along the length of the roller parallel to the roller axis. Roller 650 includes a rigid core member 660, a compliant base-cushion layer 661 formed on the core member, a stiffening layer 662 surrounding and in intimate contact with the base-cushion layer 661 with stiffening layer 662 including a mesh having a density variable in a direction parallel to the roller axis of rotation indicated by G . . . G', and an outer compliant layer 663 on the stiffening layer. Stiffening layer 662 is separately indicated diagrammatically in side view for clarity of understanding. In an embodiment of a stiffening layer 662' depicted in a side view representation in FIG. 10*b*, a woven fabric 664 is shown having a simple diagonal mesh, the mesh density varying, in a direction parallel to axis G" . . . G'", from a minimum value at or near each end of the stiffening layer 662' towards a maximum value located at substantially the midpoint along the length of the stiffening layer (crossings of fibers are not shown in detail). For clarity, a greatly enlarged mesh 664 is indicated in FIG. 10*b*. For an inventive fuser roller, it is preferred that diameters of the fibers, threads or wires of which the mesh is made be small enough to produce no measurable effect on fusing uniformity. Similarly, it is preferred for an inventive fuser roller that the interstices between the fibers, threads or wires of which the mesh is made be small enough to produce no measurable effect on fusing uniformity. It is to be understood that, in other suitable embodiments of the stiffening layer 662 (not illustrated) the mesh may include any suitable weave, and it may have a simple form of a warp and a woof, or it may include a more complex weave, with the threads or wires passing in any suitable directions, including parallel and perpendicular to the axis G . . . G'. The mesh may be made of one or more different kinds of fibers, or fibers of one or more different diameters. For example, the simple mesh of the fabric 664, may be considered to be made of a warp and a woof, with the warp and woof being optionally made of different materials, or having fibers or threads of different diameters. The longitudinal variation of the mesh density along the length of the stiffening layer may be smooth, as depicted for layer 662', or it may have more or less abrupt changes. For example, individual longitudinal lengths or sections having discretely different mesh densities may be used to make layer 662. The individual longitudinal lengths need not be joined to form a continuous tube but may be separated by gaps, the gaps being preferably small enough so as to cause no noticeable effects at the exterior surface of compliant layer 663 that could result in a decreased fusing performance or quality. Moreover, the maximum value of the mesh density of the stiffening layer 662 may, if desired, extend for a suitable distance on either side of substantially the midpoint along the length of the roller 650. When outer compliant layer 663 is formed on the stiffening layer, the material of layer 663 may be made to penetrate and fill the interstices of the mesh. Alternatively, the interstices of the mesh included in the stiffening layer may be filled by any suitable other material, preferably a compliant material, and this is preferably done before the outer compliant layer 663 is formed on the stiffening layer 662.

Figure 11A:
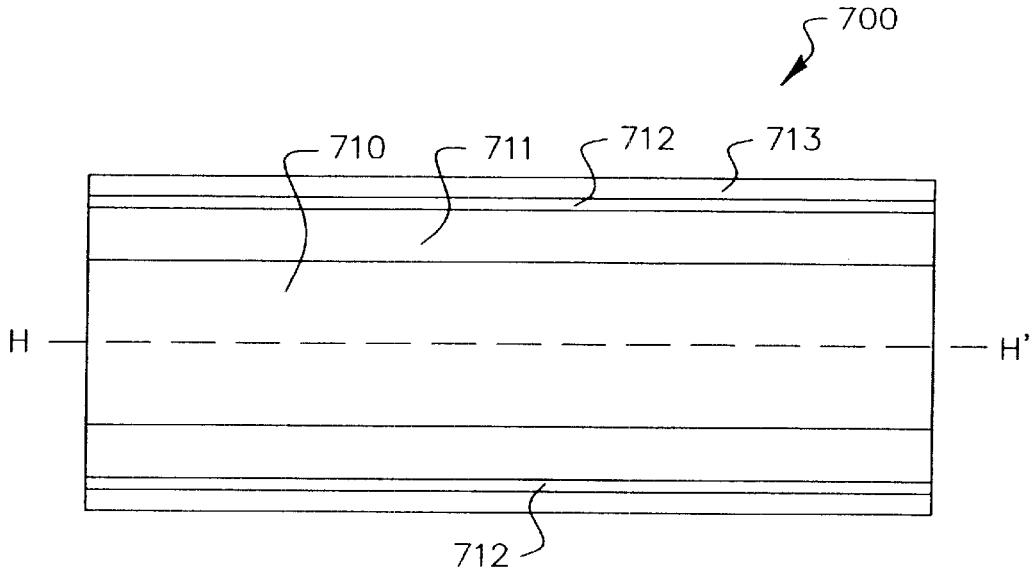
FIG. 11*a* is a cross sectional view of a roller according to the invention illustrating the various layers.
Figure 11B:
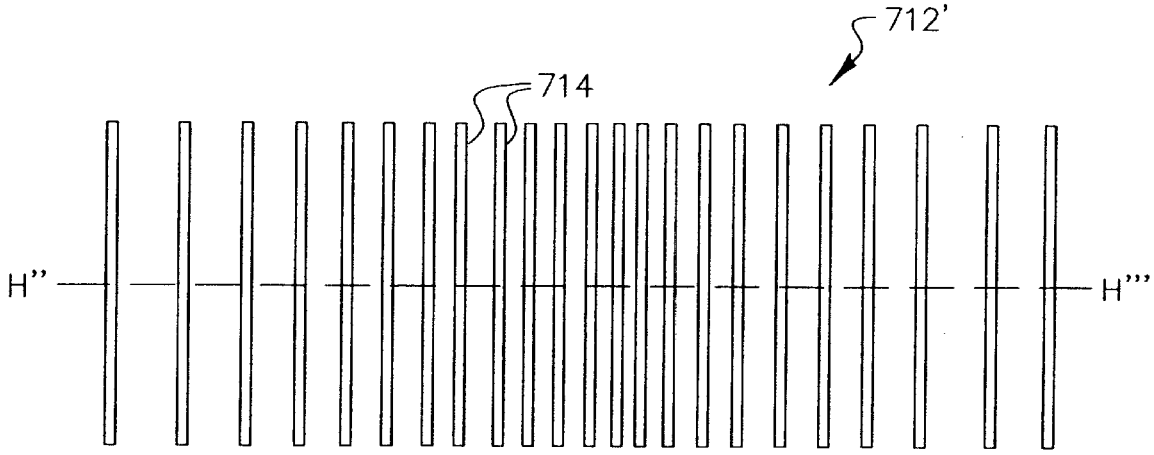
FIG. 11*b* shows a diagrammatic representation of a roller according to this invention, having a stiffening layer which includes a cordage in which the cordage density is variable along the length of the roller.

In yet another embodiment utilizing a variably stiff stiffening layer, the stiffening layer of a roller of a fusing station according to the invention includes a cordage, and the variation of stiffness is produced by a systematic variation, as measured in the plane of the stiffening layer, of the density of the cordage, i.e., of the number of cords per unit length cutting a direction parallel to the axis of rotation of the roller. It is preferred that the cordage density be lowest near the ends of an inventive roller, and highest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the cordage may include natural or synthetic fibers, metal wires or strips, or any other suitable material, e.g., in the form of a wound filament which can for example be wound as a continuous strand around a compliant layer, or provided in ring form around the compliant layer as a set of rings having their centers substantially concentric with the axis of rotation of the roller. FIG. 11*a* shows a longitudinal cross section of a diagrammatic representation of an exemplary inventive cylindrically symmetric roller, indicated as 700, having a stiffening layer 712 which includes a cordage in which the cordage density is systematically variable along the length of the roller parallel to the roller axis. Roller 700 includes a rigid core member 710, a compliant base-cushion layer 711 formed on the core member, a stiffening layer 712 surrounding and in intimate contact with the base-cushion layer 711, the stiffening layer 712 including a cordage density variable in a direction parallel to the roller axis of rotation indicated by H . . . H', and an outer compliant layer 713 on the stiffening layer. For clarity of understanding, an embodiment of a stiffening layer 712' including a cordage is depicted in a side view representation in FIG. 11*b*, with individual rings of cordage depicted edge on labeled 714, the rings of cordage being centered on an axis H" . . . H'" and having a density varying, in a direction parallel to axis H" . . . H'", from a minimum value at or near each end of the stiffening layer 712' to a maximum value located at substantially the midpoint along the length of the stiffening layer. For clarity, a greatly reduced cordage density 714 is indicated in FIG. 11*b*. For an inventive fuser roller, it is preferred that diameters of the fibers, threads or wires of which the cordage is made be small enough to produce no measurable effect on fusing uniformity. Similarly, it is preferred for an inventive fuser roller that the cordage density is made high enough, and the interstices between the fibers, threads or wires of which the cordage is made be small enough, to produce no measurable effect on fusing uniformity. It is to be understood that, in other suitable embodiments of the stiffening layer 712 (not illustrated) the cordage may include any suitable winding around the base-cushion layer 711, in any suitable directions, and there may also be crossings of the windings, including more than one layer. The cordage may be made of one or more different kinds of fibers, threads or wires. Alternatively, the cordage may be made of interspersed fibers, threads or wires having one or more different diameters. The longitudinal variation of the cordage density along the length of the stiffening layer may be smooth, as shown for example by the cordage 712', or it may have more or less abrupt changes. For example, individual longitudinal lengths or sections having discretely different cordage densities, with the cordage in each of the lengths in the form of continuous windings, may be used to make layer 712. The individual longitudinal lengths need not be joined but may be separated by gaps, the gaps being preferably small enough so as to cause no noticeable effects at the exterior surface of compliant layer 713 that could result in a decreased fusing performance or quality. Moreover, the maximum value of the cordage density of the stiffening layer 712 may, if desired, extend for a suitable distance on either side of substantially the midpoint along the length of the roller 700. When outer compliant layer 713 is formed on the stiffening layer, the material of layer 713 may be made to penetrate and fill the interstices of the cordage. Alternatively, the interstices of the cordage included in the stiffening layer may be filled by any suitable other material, preferably a compliant material, and this is preferably done before the outer compliant layer 713 is formed on the stiffening layer 712.

Figure 12:
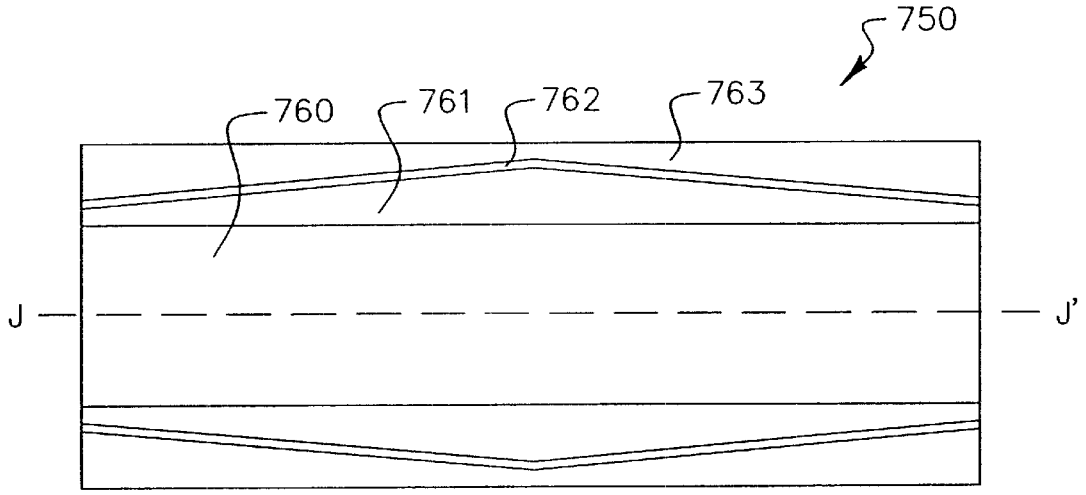
FIG. 12 shows a diagrammatic representation of a roller according to this invention, provided with a stiffening layer having a depth within the roller that varies in a direction parallel to the roller axis.

In an additional embodiment for providing a predetermined variation of overdrive along the length of a roller of a fusing station according to the invention, the roller may be provided with a stiffening layer which is located at different depths along the length of the roller. It is preferred that the stiffening layer is located deepest near each end of the roller, and shallowest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. FIG. 12 shows a longitudinal cross section of a diagrammatic representation of an exemplary inventive cylindrically symmetric roller, indicated as 750, provided with a stiffening layer 762 having a depth within roller 750 that varies systematically in a direction parallel to the roller axis. Roller 750 includes a rigid core member 760, a compliant base-cushion layer 761 formed on the core member, a stiffening layer 762 surrounding and in intimate contact with the base-cushion layer 761 with the stiffening layer 762 having a depth which is variable in a direction parallel to an axis of rotation indicated by J . . . J', and an outer compliant layer 763 on the stiffening layer. Stiffening layer 762 is shown at a depth below the compliant layer increasing from a minimum value at or near each end of the roller 750 towards a maximum value located at substantially the midpoint along the length of the roller. Preferably, a sum of the thicknesses of layers 761 and 763 is substantially constant along the entire length of the roller. For clarity of understanding in FIG. 12, the variation of depth of stiffening layer 762 has been greatly exaggerated along the entire length of the roller 750. The longitudinal variation of depth of stiffening layer 762 may be smooth from an end of the roller 750 to substantially the midpoint, as depicted in FIG. 12, or it may have more or less abrupt changes. For example, individual longitudinal lengths or sections having discretely different depths below the outer compliant layer 763 may be used to make layer 762. The individual longitudinal lengths need not be joined to form a continuous tube but may be in the form of individual tubes, made, e.g., of metal, having different diameters, the tubes being separated by gaps, the gaps being preferably small enough so as to cause no noticeable effects at the exterior surface of compliant layer 763 that could result in a decreased fusing performance or quality. Moreover, the maximum value of the depth of stiffening layer 762 may, if desired, extend for a suitable distance on either side of substantially the midpoint along the length of the roller 750. The stiffening layer 762 having a variable depth may also include a mesh or a cordage (not illustrated).

Figure 13:
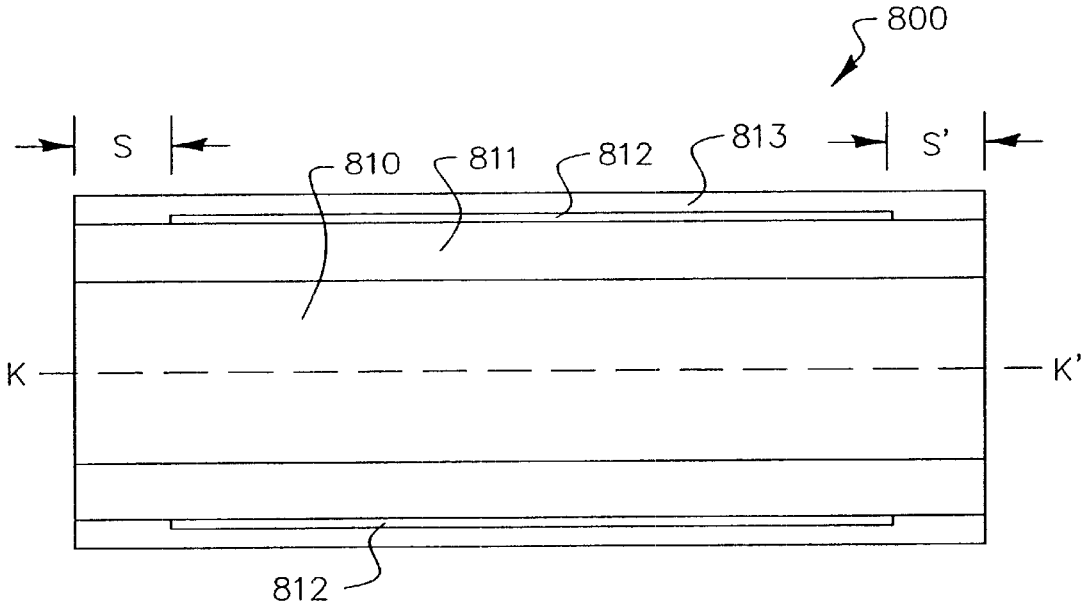
FIG. 13 shows a diagrammatic representation of a roller of an inventive fusing station, the roller including a stiffening layer which is shorter than the length of a receiver, as measured parallel to the fuser roller axis.

In a further additional embodiment for providing a predetermined variation of overdrive along the length of a roller of a fusing station according to the invention, the roller includes a stiffening layer which is shorter than the length of a receiver, as measured parallel to the fuser roller axis. Each edge of a paper sheet passing through the fusing station is preferably located less than about 2 inches beyond a corresponding end of the stiffening layer, and more preferably, less than about 1.5 inches beyond a corresponding end of the stiffening layer. By providing the stiffening layer to be shorter than the length of the fuser roller that contacts the paper, the overdrive is increased in the areas near the edges of a paper sheet for which there is no stiffening layer, as compared to rest of the paper, thereby providing a mechanism to reduce wrinkling of a paper sheet passing through the nip. FIG. 13 shows a longitudinal cross section of a diagrammatic representation of an exemplary inventive cylindrically symmetric roller, indicated as 800, rotatable about an axis K . . . K' and including a rigid core member 810, a compliant base-cushion layer 811 formed on the core member, a stiffening layer 812 surrounding and in intimate contact with the base-cushion layer 811, and an outer compliant layer 813 on the stiffening layer. As indicated in FIG. 13, the stiffening layer 812 is shorter than the roller 800, so that portions having indicated respective lengths s and s' located at each end of the outer surface of the base-cushion layer 811 are not covered by the stiffening layer 812. Preferably, the portions of the base-cushion layer 811 not covered by the stiffening layer are of approximately equal length, and these portions are covered by the outer compliant layer 813. It is preferred that an outer diameter of roller 800 be uniformly the same along the length of the roller. This may be accomplished by making the portions of the outer compliant layer 813 correspondingly thicker where there is no underlying stiffening layer 812 on top of base-cushion layer 811, the base-cushion layer preferably having a diameter which is uniformly the same along the length of the roller 800. Alternatively, the outer diameter of roller 800 may be made uniformly the same along the length of the roller by having the base-cushion layer correspondingly thicker where there is no stiffening layer (not illustrated).

Figure 14:
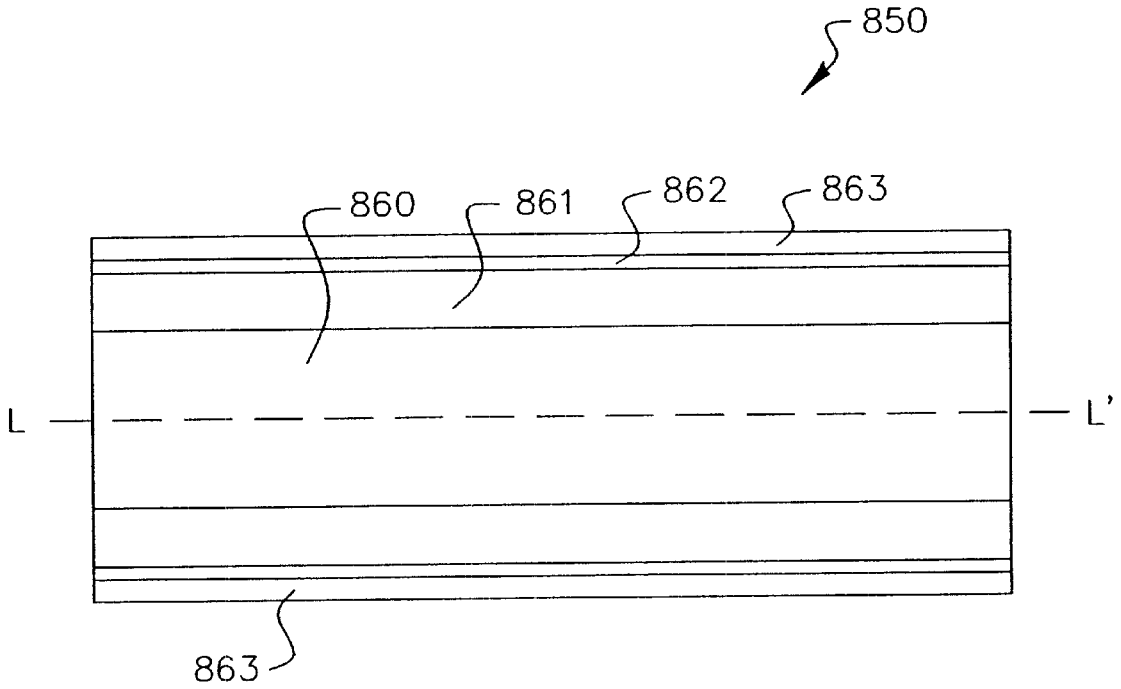
FIG. 14 shows a diagrammatic representation of a roller of an inventive fusing station, the roller having an outer diameter that varies along the length of the roller, the roller including an outer compliant layer which is thicker towards the ends of the roller than it is at substantially the midpoint along the length of the roller.

In a still further additional embodiment for providing a predetermined variation of overdrive along the length of a compliant roller of a fusing station according to the invention, the compliant roller including a stiffening layer may be provided with an outside diameter which varies along a direction parallel to the roller axis. It is preferred, for an inventive roller, that a maximum of the outside diameter is located near each end of the roller and a minimum is located substantially midway along the length of the roller, increasing the overdrive near the edges of a paper sheet, as compared to the center of the paper, and thereby providing a mechanism to ensure that all portions of a paper sheet spend substantially the same time passing through the nip. FIG. 14 shows a longitudinal cross section of a diagrammatic representation of an exemplary inventive cylindrically symmetric roller, indicated as 850, having a profiled outer diameter and being rotatable about an axis L . . . L', roller 850 including a rigid cylindrical core member 860, a compliant base-cushion layer 861 formed on the core member 860, a stiffening layer 862 surrounding and in intimate contact with the base-cushion layer 861, and a longitudinally profiled outer compliant layer 863 on the stiffening layer. Preferably, each of both the base-cushion layer 861 and the stiffening layer 862, have a substantially uniform thickness along the length of the roller. The outer compliant layer 863 is thicker towards the ends of roller 850 than it is at substantially the midpoint along the length of the roller. It may be desirable in certain applications to vary the outer diameter of roller 850 by including a longitudinally profiled core member 860 (not illustrated) or a longitudinally profiled base-cushion layer 861 (not illustrated) in order to provide a desired variation of outer diameter along the length of roller 850.

Figure 5:
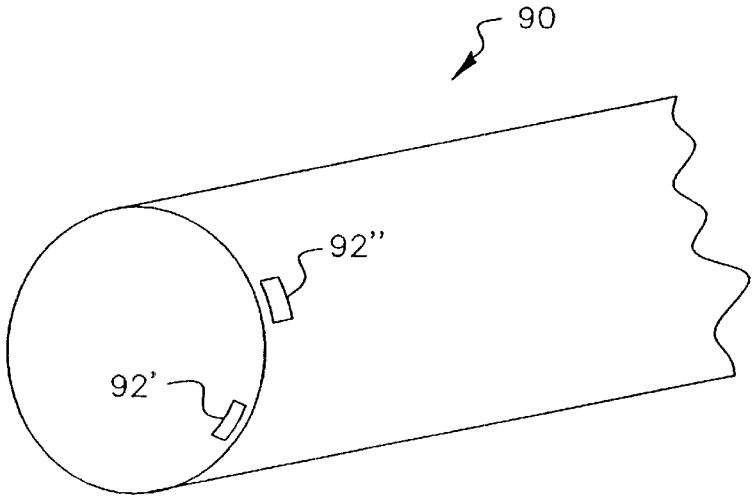
FIG. 5 is a diagrammatic representation of the outside of a roller according to this invention, having marked on its outer surface a descriptive indicia, machine readable, located in a small area located close to an end of the roller.
Figure 6:
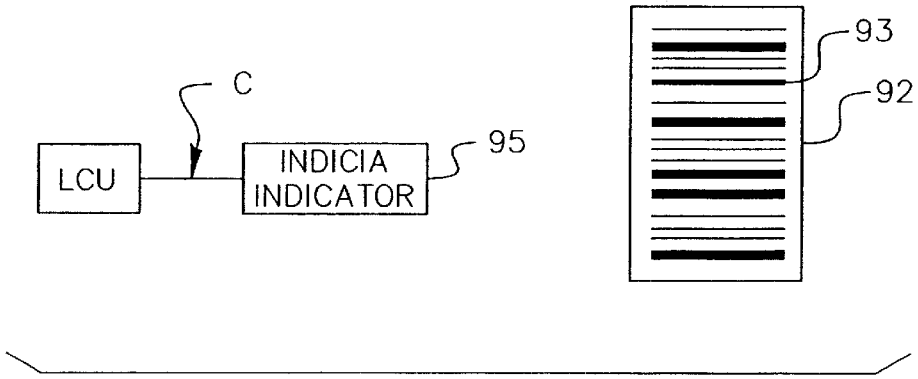
FIG. 6 is a diagrammatic representation of an indicia in the form of a bar code and its detection by an indicia indicator.

FIG. 5 diagrammatically shows an end portion of an inventive roller, indicated as 90, on which an outer surface has marked on it a set of descriptive markings or indicia which are provided to indicate a parameter (parameters) relative to the roller. The roller 90 may be representative of a fuser roller including a stiffening layer, or alternatively roller 90 may be representative of a roller utilized in a fusing station of the invention, including a pressure roller comprising a stiffening layer, a hard fuser roller, or a hard pressure roller. That is, it is preferred to provide an indicia on the outer surfaces of rollers 20, 20', 20", 30, 50, 50', 60 and 70 according to the manner described for an inventive roller 90. The indicia are located in a small area 92" located on a portion of the cylindrical surface close to an end of the roller. Alternatively, the indicia are contained in a small area 92' located on an end portion of the roller, with area 92' preferably near the edge or rim (the individual layers comprising roller 90 are not shown). FIG. 6 shows a diagrammatic representation of an area 92, an enlarged view of either of the areas 92' or 92", and illustrates that the descriptive indicia may be in the form of a bar code, as indicated by the numeral 93, which may be read, for example, by a scanner. The scanner may be mounted in an electrophotographic machine so as to monitor roller 90, e.g., during operation of the machine or during a time when the machine is idle, or the scanner may be externally provided during installation of, or during maintenance of, an inventive roller 90. Generally, the indicia may be read, sensed or detected by an indicia detector 95. As indicated in FIG. 6 by the line C, the analog or digital output of the indicia detector may be sent to a logic control unit (LCU) incorporated in an electrostatographic machine utilizing an inventive roller 90, or it may be processed externally, e.g., in a portable computer during the installation or servicing of an inventive fuser roller, or it may be processed in any other suitable data processor. The indicia may be read optically, magnetically, or by a radio frequency.

In addition to a bar code 93, the indicia may comprise any suitable markings, including symbols and ordinary words, and may be color-coded. The indicia may also be read visually or interpreted by eye. A color coded indicia on a roller may include a relatively large colored area which may be otherwise devoid of markings or other features and which may readily be interpreted by eye to indicate a predetermined property of the color-coded roller. A thermally induced change of the indicia may be used to monitor the life of an inventive roller 90. For example, a color of an indicia of a color-coded inventive roller can be chosen to have a thermally induced slow fade rate, or a thermally induced slow rate of change of an initial, e.g., as-manufactured, color, whereby a fading or otherwise thermally induced color change can be used as a measure of elapsed life or as a measure of remaining life of the roller. Such a color change may be monitored by eye. Preferably, the color change is measured by means of a reflected light beam, e.g., by using a densitomer or spectrophotometer, or any other suitable means of measuring the intensity or color of light reflected from the indicia, with the reflected optical information provided to a LCU or other computer.

An indicia may also be utilized to measure the wear rate of an inventive roller, e.g., by providing a portion of the indicia having a predetermined wear rate. The wear rate of an indicia may be measured optically, e.g., by monitoring the reflection optical density of a portion of the indicia which may be subject to wear, or by other suitable means. Suitable materials for the indicia are for example inks, paints, magnetic materials, reflective materials, and the like, which may be applied directly to the surface of the roller.

Alternatively, the indicia may be located on a label that is adhered to the outer surface of the roller. The indicia may also be in raised form or produced by stamping with a die or by otherwise deforming a small local area on the outer surface of the roller, and the deformations may be sensed mechanically or otherwise detected or read using an indicia detector 95 in the form of a contacting probe or by other mechanical mechanisms.

Different types of information may be encoded or recorded in the indicia. For example, the outside diameter of a roller may be recorded so that nip width parameters can be accordingly adjusted. For example, the operating temperature range and operating fusing nip pressure may be recorded in the indicia. The date of manufacture of the roller may be recorded in the indicia for diagnostic purposes, so that the end of useful life of the roller could be estimated for timely replacement. Specific information for each given roller regarding the roller runout, e.g., as measured after manufacture, may also be recorded in the indicia.

It will be evident that the indicia according to the invention are distinguished from information stored electronically as described by M. E. Beard et al., U.S. Pat. No. 6,016,409, which discloses a module that includes an electronically-readable memory whereby the control system of the printing apparatus reads out codes from the electronically readable memory. According to the present invention, an indicia comprises a physical alteration of the surface of a roller 90 and does not comprise electronic information as such, even though after detection by the indicia detector 95 the detected information may be subsequently converted to electronic form, e.g., in a computer.

In accordance with the above, and in the following numbered paragraphs below, it is apparent that this invention has been described as follows:

¶1A. A conformable roller for use in a fusing station of an electrostatographic machine and having an axis of rotation, comprising:

a rigid cylindrically symmetric core member;

a compliant base-cushion layer formed on the core member;

a stiffening layer in intimate contact with and surrounding the base-cushion layer;

a compliant release layer coated on the stiffening layer; and wherein the fusing station is provided with an externally heated fuser roller.

¶1B. A conformable externally heated toner fuser roller for use in a fusing station of an electrostatographic machine and having an axis of rotation, comprising:

a rigid cylindrically symmetric core member;

a compliant base-cushion layer formed on the core member;

a stiffening layer in intimate contact with and surrounding the base-cushion layer;

a compliant release layer coated on the stiffening layer; and a heat source which is external to the roller.

¶1C. A conformable pressure roller for use in a fusing station of an electrostatographic machine and having an axis of rotation, comprising:

a rigid cylindrically symmetric core member;

a compliant base-cushion layer formed on the core member;

a stiffening layer in intimate contact with and surrounding the base-cushion layer;

a compliant release layer coated on the stiffening layer; and wherein the fusing station is provided with an externally heated fuser roller.

¶2. The toner fuser roller according to Paragraph 1B wherein the heat source comprises one or more heating rollers in direct contact with the fuser roller.

¶3. The roller according to Paragraph 1A wherein the base-cushion layer comprises a poly(dimethylsiloxane) elastomer.

¶4. The roller according to Paragraph 1A wherein the basecushion layer comprises a fluoroelastomer or an EPDM rubber.

¶5. The roller according to Paragraph 1B wherein the base-cushion layer has a thickness in a range of 0.25 mm to 25 mm.

¶6. The roller according to Paragraph 5 wherein the base-cushion layer has a thickness in a range of 1.25 mm to 12.5 mm.

¶7. The toner fuser roller according to Paragraph 1B wherein the base-cushion layer has a thermal conductivity less than 0.4 BTU/hr/ft/°F.

¶8. The toner fuser roller according to Paragraph 7 wherein the base-cushion layer has a thermal conductivity in a range of 0.1 BTU/hr/ft/°F–0.3 BTU/hr/ft/°F.

¶9. The roller according to Paragraph 1A wherein the base-cushion layer has a Young's modulus in a range of 0.05 MPa–10 MPa.

¶10. The roller according to Paragraph 9 wherein the base-cushion layer has a Young's modulus in a range of 0.1 MPa–1 MPa.

¶11. The toner fuser roller according to Paragraph 1B wherein the base-cushion layer further comprises a particulate filler.

¶12. The toner fuser roller according to Paragraph 11 wherein the particulate filler in the base-cushion layer is selected from the group consisting of chromium (III) oxide, aluminum oxide, iron oxide, calcium oxide, magnesium oxide, nickel oxide, tin oxide, zinc oxide, copper oxide, titanium oxide, silicon oxide and mixtures thereof.

¶13. The toner fuser roller according to Paragraph 10 wherein said particulate filler comprises 3 to 30 volume percent of said base-cushion layer.

¶14. The toner fuser roller according to Paragraph 13 wherein the filler comprises 5 to 20 volume percent of said base-cushion layer.

¶15. The toner fuser roller according to Paragraph 10 wherein said particulate filler comprises particles having a mean diameter in a range of 0.1 micrometer–100 micrometers.

¶16. The toner fuser roller according to Paragraph 15 wherein the filler comprises particles having a mean diameter in a range of 0.5 micrometer–40 micrometers.

¶17. The roller according to Paragraph 1A wherein said stiffening layer has a thickness less than about 500 micrometers.

¶18. The roller according to Paragraph 17 wherein said stiffening layer has a thickness in a range of 75 micrometers–250 micrometers.

¶19. The roller according to Paragraph 1A wherein said stiffening layer has a Young's modulus in a range of 0.1 GPa–500GPa.

¶20. The roller according to Paragraph 19 wherein said stiffening layer has a Young's modulus in a range of 10 GPa–350 GPa.

¶21. The roller according to Paragraph 1A wherein said stiffening layer is selected from one or more metals of a group consisting of nickel, copper, gold, and steel.

¶22. The roller according to Paragraph 21 wherein the stiffening layer is made of nickel.

¶23. The roller according to Paragraph 1A wherein the compliant release layer comprises a fluoroelastomer or a silicone rubber.

¶24. The roller according to Paragraph 1A wherein said compliant release layer has a thickness less than about 1 millimeter.

¶25. The roller according to Paragraph 24 wherein said compliant release layer has a thickness in a range of 25 micrometers to 250 micrometers.

¶26. The toner fuser roller according to Paragraph 1B wherein the compliant release layer has a thermal conductivity in a range of 0.2 BTU/hr/ft/°F.–0.5 BTU/hr/ft/°F.

¶27. The roller according to Paragraph 1A wherein said compliant release layer has a Young's modulus in a range of 0.05 MPa–10 MPa.

¶28. The roller according to Paragraph 27 wherein said compliant release layer has a Young's modulus in a range of 0.1 MPa–1 MPa.

¶29. The toner fuser roller according to Paragraph 1B wherein said compliant release layer further comprises a particulate filler.

¶30. The toner fuser roller according to Paragraph 29 wherein said particulate filler in the release layer is selected from the group consisting of aluminum oxide, iron oxide, calcium oxide, magnesium oxide, nickel oxide, tin oxide, zinc oxide, copper oxide, titanium oxide, silicon oxide, graphite, and mixtures thereof.

¶31. The toner fuser roller according to Paragraph 30 wherein said particulate filler in said release layer is zinc oxide.

¶32. The toner fuser roller according to Paragraph 29 wherein said particulate filler comprises 5 to 50 volume percent of said release layer.

¶33. The toner fuser roller according to Paragraph 32 wherein the filler comprises 10 to 35 volume percent of said release layer.

¶34. The toner fuser roller of Paragraph 1B further comprising an elastomeric thin barrier layer coated on the stiffening layer.

¶35. The toner fuser roller of Paragraph 34 wherein the thin barrier layer comprises a fluoroelastomer plus 20 to 40 volume percent of a particulate filler, wherein the fluoroelastomer is preferably a random copolymer formed from mixtures of monomer units selected from vinylidene fluoride, tetrafluoroethylene, and hexafluoropropylene, and the filler comprises aluminum oxide, iron oxide, calcium oxide, magnesium oxide, nickel oxide, tin oxide, and mixtures thereof.

¶36. The toner fuser roller of Paragraph 34 wherein said barrier layer has a thickness in a range of 10 micrometers to 50 micrometers.

¶37. The roller of Paragraph 1A wherein the base-cushion layer has a Poisson's ratio between 0.2 and 0.5.

¶38. The roller of Paragraph 37 wherein the base-cushion layer has a Poisson's ratio between 0.45 and 0.5.

¶39. The roller of Paragraph 1A wherein the compliant release layer has a Poisson's ratio between 0.4 and 0.5.

¶40. The roller of Paragraph 37 wherein the compliant release layer has a Poisson's ratio between 0.45 and 0.5.

¶41. A simplex fusing station of an electrostatographic machine, comprising:

a rotating externally heated compliant fuser roller;

a counter-rotating hard pressure roller engaged to form a fusing nip with the compliant fuser roller; and wherein the compliant fuser roller further comprises a base-cushion layer surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an outer compliant layer surrounding the stiffening layer.

¶42. A simplex fusing station of an electrostatographic machine, comprising:

a rotating externally heated compliant fuser roller;

a counter-rotating compliant pressure roller engaged to form a fusing nip with the compliant fuser roller;

wherein the compliant fuser roller further comprises a base-cushion layer surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an outer compliant release layer surrounding the stiffening layer; and wherein also the compliant pressure roller further comprises a base-cushion layer surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an optional outer compliant layer surrounding the stiffening layer.

¶43. A simplex fusing station of an electrostatographic machine, comprising:

a rotating compliant pressure roller;

a counter-rotating externally heated hard fuser roller engaged to form a fusing nip with the compliant pressure roller; and wherein the compliant pressure roller further comprises a base-cushion layer surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an optional outer compliant layer surrounding the stiffening layer.

¶44A. The simplex fusing station according to Paragraph 41 wherein the stiffening layer is in the form of a seamless tube.

¶44B. The simplex fusing station according to Paragraph 42 wherein the stiffening layer is in the form of a seamless tube.

¶44C. The simplex fusing station according to Paragraph 43 wherein the stiffening layer of the fuser roller and wherein the stiffening layer of the pressure roller each has the form of a seamless tube.

¶45. A duplex fusing station of an electrostatographic machine, comprising:

a rotating first fuser roller;

a counter-rotating second fuser roller engaged to form a pressure fusing nip with the first fuser roller;

wherein both or either of the first and second fuser rollers further comprises a base-cushion layer surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an outer compliant release layer surrounding the stiffening layer; and wherein also both or either of the first and second fuser rollers is heated by an external source of heat.

¶46. A toner fusing method, for use in an electrostatographic machine, comprising:

forming a fusing nip by engaging a rotating externally heated compliant fuser roller and a counter-rotating hard pressure roller, one of the rollers being a driven roller and the other frictionally driven by pressure contact in the nip;

providing one or more heating rollers contacting and thereby heating the fuser roller;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein the externally heated fuser roller further comprises a rigid cylindrical core member, a compliant base-cushion layer formed on the core member, a stiffening layer in intimate contact with and surrounding the base-cushion layer, and an outer compliant layer coated on the stiffening layer.

¶47. The toner fusing method of Paragraph 46 wherein:

the compliant base-cushion layer of the fuser roller comprises an elastomer and contains 3 to 30 volume percent of a particulate filler having a particle size in a range of 0.1 micrometer to 100 micrometers, the base-cushion layer further comprising a thickness in a range of 0.25 mm to 25 mm, a thermal conductivity in a range of 0.08 to 0.3 BTU/hr/ft/°F., and a Young's modulus in a range of 0.05 MPa to 10 MPa;

the stiffening layer comprises a flexible material having a thickness less than about 500 micrometers and a Young's modulus in a range of 0.1 GPa to 500 GPa; and the outer compliant layer comprises an elastomer and contains 5 to 50 volume percent of a particulate filler having a particle size in a range of 0.1 micrometer to 100 micrometers, the compliant release layer further comprising a thickness less than approximately 1 mm, a thermal conductivity in a range of 0.2 to 0.5 BTU/hr/ft/°F., a Poisson's ratio between 0.4 and 0.5, and a Young's modulus in a range of 0.05 MPa to 10 MPa.

¶48. The toner fusing method according to Paragraph 47 wherein said outer compliant layer comprises a fluoroelastomer or a silicone rubber.

¶49. The toner fusing method according to Paragraph 47 wherein said compliant base-cushion layer comprises a poly(dimethylsiloxane) elastomer , a fluoroelastomer, or an EPDM rubber.

¶50. The toner fusing method according to Paragraph 47 wherein said stiffening layer is made of nickel.

¶51. A toner fusing method, for use in an electrostatographic machine, comprising:

forming a fusing nip by engaging a rotating externally heated hard fuser roller and a counter-rotating compliant pressure roller, one of the rollers being a driven roller and the other frictionally driven by pressure contact in the nip;

providing one or more heating rollers contacting and thereby heating the fuser roller;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein the pressure roller comprises a rigid cylindrical core member, a compliant base-cushion layer formed on the core member, and a stiffening layer in intimate contact with and surrounding the base-cushion layer.

¶52. The toner fusing method of Paragraph 51 wherein:

the compliant base-cushion layer of the pressure roller comprises an elastomer having a thickness in a range of 0.25 mm to 25 mm and a Young's modulus in a range of 0.05 MPa to 10 MPa; and the stiffening layer comprises a flexible material having a thickness less than about 500 micrometers and a Young's modulus in a range of 0.5 GPa to 500 GPa.

¶53. The toner fusing method according to Paragraph 51 wherein said compliant base-cushion layer comprises a poly(dimethylsiloxane) elastomer, a fluoroelastomer or an EPDM rubber.

¶54. The toner fusing method according to Paragraph 51 wherein said stiffening layer is made of nickel.

¶55. The toner fusing method according to Paragraph 51 wherein the pressure roller further includes an optional outer compliant layer coated on the stiffening layer, the outer compliant layer comprising an elastomer having a thickness less than about 1 millimeter, and having a Poisson's ratio between 0.4 and 0.5 and a Young's modulus in a range of 0.05 MPa–10 MPa.

¶56A. The fusing station of Paragraph 42 wherein the base-cushion layer of the pressure roller has a Poisson's ratio in a range from 0.2 to 0.5.

¶56B. The fusing station of Paragraph 43 wherein the base-cushion layer of the pressure roller has a Poisson's ratio in a range from 0.2 to 0.5.

¶57A. The fusing station of Paragraph 56A wherein the base-cushion layer of the pressure roller has a Poisson's ratio in a range from 0.45 to 0.5.

¶57B. The fusing station of Paragraph 56B wherein the base-cushion layer of the pressure roller has a Poisson's ratio in a range from 0.45 to 0.5.

¶58A. The fusing station of Paragraph 41 wherein the base-cushion layer of the fuser roller has a Poisson's ratio in a range from 0.2 to 0.5.

¶58B. The fusing station of Paragraph 43 wherein the base-cushion layer of the fuser roller has a Poisson's ratio in a range from 0.2 to 0.5.

¶58C. The fusing station of Paragraph 45 wherein the base-cushion layer of each of the fuser rollers has a Poisson's ratio in a range from 0.2 to 0.5.

¶59A. The fusing station of Paragraph 58A wherein the base-cushion layer of the fuser roller has a Poisson's ratio in a range from 0.45 to 0.5.

¶59B. The fusing station of Paragraph 58B wherein the base-cushion layer of the fuser roller has a Poisson's ratio in a range from 0.45 to 0.5.

¶59C. The fusing station of Paragraph 58C wherein the base-cushion layer of each of the fuser rollers has a Poisson's ratio in a range from 0.45 to 0.5.

¶60A. The fusing station of Paragraph 41 wherein the Poisson's ratio of the outer compliant layer is between 0.4 and 0.5.

¶60B. The fusing station of Paragraph 42 wherein the Poisson's ratio of the outer compliant layer is between 0.4 and 0.5.

¶60C. The fusing station of Paragraph 43 wherein the Poisson's ratio of the outer compliant layer of the fuser roller and the Poisson's ratio of the outer compliant layer of the pressure roller is each between 0.4 and 0.5.

¶60D. The fusing station of Paragraph 45 wherein the Poisson's ratio of the outer compliant layer of both fuser rollers is between 0.4 and 0.5.

¶61A.The fusing station of Paragraph 60A wherein the Poisson's ratio of the outer compliant layer is between 0.45 and 0.5.

¶61B. The fusing station of Paragraph 60B wherein the Poisson's ratio of the outer compliant layers is between 0.45 and 0.5.

¶61C. The fusing station of Paragraph wherein the Poisson's ratio of the outer compliant layer of the fuser roller and the Poisson's ratio of the outer compliant layer of the pressure roller is each between 0.45 and 0.5.

¶61D. The fusing station of Paragraph 60D wherein the Poisson's ratio of the outer compliant layer of both fusing rollers is between 0.45 and 0.5.

¶62A. The toner fusing method of Paragraph 46 wherein the base-cushion layer has a Poisson's ratio in a range from 0.2 to 0.5.

¶62B. The toner fusing method of Paragraph 51 wherein the base-cushion layer has a Poisson's ratio in a range from 0.2 to 0.5.

¶63A. The toner fusing method of Paragraph 62A wherein the base-cushion layer has a Poisson's ratio in a range from 0.45 to 0.5.

¶63B. The toner fusing method of Paragraph 62B wherein the base-cushion layer has a Poisson's ratio in a range from 0.45 to 0.5.

¶64. The toner fuser roller of Paragraph 1B wherein the release layer has a roughness value, Ra, not exceeding about 10 micro inches.

¶65. The simplex fusing station according to Paragraph 41 wherein the hard pressure roller comprises a rigid cylindrical tube, optionally coated with an elastomer less than 1.25 mm thick comprising a fluoroelastomer or a silicone rubber.

¶66. The simplex fusing station according to Paragraph 43 wherein the hard fuser roller comprises a thermally conductive rigid cylindrical tube, optionally coated with an elastomer less than 1.25 mm thick comprising a fluoroelastomer or a silicone rubber.

¶67. The toner fusing method according to Paragraph 46 wherein the hard pressure roller comprises a rigid cylindrical tube, optionally coated with an elastomer less than 1.25 mm thick comprising a fluoroelastomer or a silicone rubber.

¶68. The toner fusing method according to Paragraph 51 wherein the hard fuser roller comprises a thermally conductive rigid cylindrical tube, optionally coated with an elastomer less than 1.25 mm thick comprising a fluoroelastomer or a silicone rubber.

¶69. The roller according to Paragraph 1A wherein the stiffening layer has an axial variation of stiffness, the stiffness being measured parallel to a tangential direction of rotation of the roller, with the magnitude of said stiffness varying in a direction parallel to the roller axis.

¶70. The roller according to Paragraph 69 wherein the variation of stiffness is substantially symmetric about the midpoint of the roller as measured along the length of the roller.

¶71. The roller according to Paragraph 69 wherein the variation of stiffness is produced by a variation of thickness of the stiffening layer.

¶72. The roller according to Paragraph 71 wherein the thickness is smaller near the ends of the roller than at the midpoint of the roller.

¶73. The roller according to Paragraph 69 wherein the variation of stiffness is produced by a variation of the Young's modulus of the stiffening layer.

¶74. The roller according to Paragraph 73 wherein the Young's modulus has a smaller magnitude near each end of the roller than at the midpoint of the roller.

¶75. The roller according to Paragraph 69 wherein the variation of stiffness is produced by providing a large number of holes in the stiffening layer, the area per unit length occupied by holes varying along the length of the roller.

¶76. The roller according to Paragraph 75 wherein there is more area occupied by holes, per unit area of the stiffening layer, near the ends of the roller than at the midpoint of the roller.

¶77. The roller according to Paragraph 69 wherein the variation of stiffness is produced by providing a stiffening layer in the form of a mesh or fabric in which the mesh density or fabric density is variable along the length of the roller.

¶78. The roller according to Paragraph 77 wherein the mesh or fabric density is lower near the ends of the roller than at the midpoint of the roller.

¶79. The roller according to Paragraph 69 wherein the stiffening layer comprises a cordage and the variation of stiffness is produced by a variation in the number of cords per unit length, as measured in the plane of the stiffening layer, cutting a direction parallel to the axis of rotation of the roller.

¶80. The roller according to Paragraph 79 wherein the number of cords per unit length is largest substantially midway along the length of the roller and smallest near each end of the roller.

¶81. The roller according to Paragraph 79 wherein said cordage comprises a wound filament.

¶82. The roller according to Paragraph 79 wherein said wherein said cordage comprises a set of rings having their centers substantially concentric with said axis of rotation.

¶83. The roller according to Paragraph 1A wherein the outside diameter of a roller varies along a direction parallel to the roller axis.

¶84. The roller according to Paragraph 83 wherein a maximum of said outside diameter is located near each end of the roller and a minimum is located substantially midway along the length of the roller.

¶85. The roller according to Paragraph 1A wherein the stiffening layer is located at a depth below the outer surface which varies along the length of the roller.

¶86. The roller according to Paragraph 85 wherein the depth is greatest near each end of the roller and is smallest substantially midway along the length of the roller.

¶87. The fuser roller according to Paragraph 1B, wherein the stiffening layer is shorter than the length of a receiver, as measured parallel to the roller axis, when the said fuser roller is being utilized for fusing a toner image to a receiver.

¶88. The fuser roller according to Paragraph 87, wherein said receiver has edges perpendicular to the axis of rotation, each one of said edges being located less than about 2 inches beyond a corresponding end of the stiffening layer.

¶89. The fuser roller according to Paragraph 88 wherein each one of said edges is located less than about 1.5 inches beyond a corresponding end of the stiffening layer.

What is claimed is:

1. A conformable roller for use in a fusing station of an electrostatographic machine, said fusing station being provided with a pressure roller for fusing a toner image on a receiver, said fuser roller made from a plurality of layers surrounding an axis of rotation, said conformable roller comprising:

a rigid cylindrically symmetric core member;

a compliant base-cushion layer formed on the core member;

a stiffening layer in intimate contact with and surrounding the base-cushion layer;

a compliant release layer coated on the stiffening layer; and said fusing station including an external heat source for said fuser roller, and at least one of said plurality of layers being thermally resistive.

2. A conformable roller according to claim 1 which is a fuser roller.

3. A conformable roller according to claim 1 which is a pressure roller.

4. A conformable roller according to claim 1 which is a both a fuser roller and a pressure roller.

5. The roller according to claim 1 wherein the stiffening layer has an axial variation of stiffness, the stiffness being measured parallel to a tangential direction of rotation of the roller, with the magnitude of said stiffness varying in a direction parallel to the roller axis.

6. The roller according to claim 5 wherein the variation of stiffness is substantially symmetric about the midpoint of the roller as measured along the length of the roller, and is produced by a variation of thickness of the stiffening layer such the thickness is smaller near the ends of the roller than at the midpoint of the roller.

7. The roller according to claim 5 wherein the variation of stiffness is produced by a variation of the Young's modulus of the stiffening layer such the Young's modulus has a smaller magnitude near each end of the roller than at the midpoint of the roller.

8. The roller according to claim 5 wherein the variation of stiffness is produced by providing a plethora of holes in the stiffening layer, the area per unit length occupied by holes varying along the length of the roller such that there is more area occupied by holes, per unit area of the stiffening layer, near the ends of the roller than at the midpoint of the roller.

9. The roller according to claim 5 wherein the variation of stiffness is produced by providing a stiffening layer in the form of a mesh or fabric in which the mesh density or fabric density is variable along the length of the roller, such the mesh or fabric density is lower near the ends of the roller than at the midpoint of the roller.

10. The roller according to claim 5 wherein the stiffening layer comprises a cordage, and the variation of stiffness is produced by a variation in the number of cords per unit length along said roller, said number of cords per unit length being measured axially in a plane of said stiffening layer, said number of cords per unit length cutting a direction in the plane of said stiffening layer parallel to said axis of rotation being largest substantially midway along the length of said roller and smallest near each end of said roller.

11. The conformable roller according to claim 1 wherein the outside diameter of said roller varies along a direction parallel to said roller axis such that a maximum of said outside diameter is located near each end of the roller and a minimum is located substantially midway along the length of said roller.

12. The conformable roller according to claim 11 wherein said outer compliant layer is provided with a profile such that the outer compliant layer is thinnest substantially midway along the length of said roller and thickest near each end of said roller.

13. The conformable roller according to claim 1 wherein said stiffening layer is located at a depth, below the outer surface of said compliant release layer, which varies along the length of said roller such that said depth is greatest near each end of said roller and is smallest substantially midway along the length of said roller.

14. The roller according to claim 1 further comprising an indicia located on an outer surface of said roller, said indicia being provided on said roller to indicate a parameter relative to said roller that may be read, sensed or detected by an indicia detector, either visually, mechanically, optically, magnetically, or by a radio frequency.

15. The conformable roller according to claim 1, wherein the stiffening layer is shorter than the length of the receiver, as measured parallel to the roller axis, when said fuser roller is being utilized for fusing a toner image to said receiver, and said receiver has edges perpendicular to said axis of rotation of said roller, each one of said edges being located less than about 2 inches beyond a corresponding end of said stiffening layer.

16. A fusing station of an electrostatographic machine, comprising:

a rotating compliant fuser roller having an external source of heat, said fuser roller having a base-cushion layer having a Poisson's ratio between 0.2 and 0.5 surrounding a rigid cylindrical core member, a stiffening layer in intimate contact with the base-cushion layer, said stiffening layer having a Young's modulus in a range of 0.1 GPa to 500 GPa and having a thickness less than 500 micrometers, and an outer compliant layer surrounding said stiffening layer, said outer compliant layer having a Poisson's ratio between 0.4 and 0.5; and a counter-rotating pressure roller engaged to form a fusing nip with said compliant fuser roller.

17. A fusing station according to claim 16 wherein said pressure roller is hard.

18. A fusing station according to claim 16 wherein said pressure roller has a base-cushion layer surrounding a rigid cylindrical core member, said base-cushion layer having a Poisson's ratio between 0.2 and 0.5, a stiffening layer in intimate contact with the base-cushion layer, said stiffening layer having a Young's modulus in a range of 0.1 GPa to 500 GPa and having a thickness less than 500 micrometers.

19. A fusing station according to claim 18 wherein said pressure roller has an outer compliant layer surrounding the stiffening layer, said outer compliant layer having a Poisson's ratio between 0.4 and 0.5.

20. A fusing station of an electrostatographic machine, comprising:

a rotating pressure roller;

a counter-rotating externally heated compliant fuser roller engaged to form a fusing nip with said pressure roller, said fuser roller having a rigid cylindrical core member, a compliant base-cushion layer formed on the core member, a stiffening layer in intimate contact with and surrounding the base-cushion layer, and an outer compliant layer coated on the stiffening layer;

wherein said compliant base-cushion layer of said fuser roller includes an elastomer and contains 3 to 30 volume percent of a particulate filler having a particle size in a range of 0.1 micrometer to 100 micrometers, said base-cushion layer further having a thickness in a range of 0.25 mm to 25 mm, a thermal conductivity in a range of 0.08 to 0.3 BTU/hr/ft/°F., a Poisson's ratio between 0.2 and 0.5, and a Young's modulus in a range of 0.05 MPa to 10 MPa;

wherein said stiffening layer includes a flexible material having a thickness in a range of 10 micrometers to 500 micrometers and a Young's modulus in a range of 0.5 GPa to 500 GPa; and wherein said outer compliant layer includes an elastomer and contains 5 to 50 volume percent of a particulate filler having a particle size in a range of 0.1 micrometer to 100 micrometers, said outer compliant layer having a thickness in a range of 10 micrometers to 50 micrometers, a thermal conductivity in a range of 0.2 to 0.5 BTU/hr/ft/°F., a Poisson's ratio between 0.4 and 0.5, and a Young's modulus in a range of 0.05 MPa to 10 MPa.

21. A fusing station of an electrostatographic machine, comprising:

a rotating compliant pressure roller, said pressure roller having a base-cushion layer surrounding a rigid cylindrical core member, said base-cushion layer having a Poisson's ratio between 0.2 and 0.5, a stiffening layer in intimate contact with the base-cushion layer, said stiffening layer having a Young's modulus in a range of 0.1 GPa to 500 GPa and having a thickness less than 500 micrometers, and an optional outer compliant layer surrounding the stiffening layer, said optional outer compliant layer having a Poisson's ratio between 0.4 and 0.5; and a counter-rotating externally heated hard fuser roller engaged to form a fusing nip with the compliant pressure roller.

22. A fusing station of an electrostatographic machine, comprising:

a rotating first heated fuser roller;

a counter-rotating second heated fuser roller engaged to form a pressure fusing nip with the first fuser roller;

wherein at least one of said first and second fuser rollers includes a base-cushion layer having a Poisson's ratio between 0.2 and 0.5 surrounding a rigid cylindrical core member, a stiffening layer in intimate contact with the base-cushion layer, the stiffening layer having a Young's modulus in a range of 0.1 GPa to 500 GPa and having a thickness less than 500 micrometers, and an outer compliant release layer having a Poisson's ratio between 0.4 and 0.5 surrounding the stiffening layer; and wherein at least one of said first and second fuser rollers is heated by an external source of heat.

23. A toner fusing method, for use in an electrostatographic machine having a fusing station according to claim 16 said toner fusing method comprising the steps of:

forming a fusing nip by engaging said rotating compliant fuser roller having an external source of heat and said counter-rotating hard pressure roller, one of the rollers being a driven roller and the other frictionally driven by pressure contact in the nip;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein a compliancy of said compliant fuser roller in combination with said stiffening layer together provide a reduced wear rate of the fuser roller and an improved quality of a toner image fused on said receiver sheet by said fusing station.

24. A method of making a conformable roller of claim 1, including the steps of:

providing said core member with said compliant base-cushion layer uniformly formed on the core member;

providing a cylindrical mandrill and then mounting on said mandrill said stiffening layer in the shape of a seamless metal tube, said metal tube having an inner diameter prior to mounting said stiffening layer on said mandrill which is smaller than the outside diameter of said base-cushion layer formed on said core member;

uniformly coating said stiffening layer by said compliant release layer; and sliding said stiffening layer coated by said release layer over said base-cushion layer formed on said core member to a suitable position on said base-cushion layer to create a completed fuser roller, the sliding being accomplished by making an inner diameter of said stiffening layer coated by said release layer temporarily larger during the sliding than an outer diameter of said base-cushion layer formed on said core member.

* * * * *